US008544866B2

(12) United States Patent
Noonan et al.

(10) Patent No.: US 8,544,866 B2
(45) Date of Patent: Oct. 1, 2013

(54) CONVERTIBLE WHEELCHAIRS WITH MOVABLE CARRIAGES FOR TRANSFERRING PATIENTS TO/FROM THE WHEELCHAIRS

(75) Inventors: Mark Noonan, New Canaan, CT (US); Stephen C. Fog, New Canaan, CT (US)

(73) Assignee: Snow Solutions, LLC, New Canaan, CT (US)

( * ) Notice: Subject to any disclaimer, the term of this patent is extended or adjusted under 35 U.S.C. 154(b) by 0 days.

(21) Appl. No.: 13/569,406

(22) Filed: Aug. 8, 2012

(65) Prior Publication Data

US 2012/0292883 A1 Nov. 22, 2012

Related U.S. Application Data

(63) Continuation of application No. PCT/US2011/024539, filed on Feb. 11, 2011.

(60) Provisional application No. 61/338,048, filed on Feb. 11, 2010.

(51) Int. Cl.
*A61G 5/00* (2006.01)
*A61G 7/14* (2006.01)

(52) U.S. Cl.
USPC ..... 280/304.1; 5/86.1; 5/81.1 HS

(58) Field of Classification Search
USPC ..... 280/250.1, 304.1, 30; 5/81.1 R, 5/81.1 HS, 85.1, 86.1; 297/DIG. 10, 352, 297/116, 117, 411.35, 411.36, 411.37, 411.38
See application file for complete search history.

(56) References Cited

U.S. PATENT DOCUMENTS

| | | | | |
|---|---|---|---|---|
| 3,261,031 | A * | 7/1966 | Gates | 5/86.1 |
| 3,379,450 | A * | 4/1968 | Jones et al. | 280/657 |
| 3,618,968 | A * | 11/1971 | Greer | 280/47.11 |
| 3,865,427 | A * | 2/1975 | Delany | 296/68 |
| 4,039,223 | A | 8/1977 | Kristensson | |
| 4,170,368 | A * | 10/1979 | Southward et al. | 280/250.1 |
| 4,632,450 | A | 12/1986 | Holdt | |
| 4,679,849 | A | 7/1987 | Torgny | |
| 4,691,962 | A | 9/1987 | Holdt | |
| 4,717,169 | A | 1/1988 | Shaffer | |
| 4,821,352 | A | 4/1989 | DiMatteo et al. | |

(Continued)

FOREIGN PATENT DOCUMENTS

WO WO 2011/100556 8/2011

OTHER PUBLICATIONS

Written Opinion dated Oct. 31, 2011 for International patent application No. PCT/US2011/024539 (published as WO 2011/100556 on Aug. 18, 2011). The instant application is a continuation of International patent application No. PCT/US2011/024539, which claims priority to U.S. Appl. No. 61/338,048; 5 pages.

(Continued)

*Primary Examiner* — Anne Marie M Boehler
(74) *Attorney, Agent, or Firm* — Harness, Dickey & Pierce, P.L.C.

(57) ABSTRACT

Exemplary embodiments are provided of wheelchairs. In an exemplary embodiment, a wheelchair generally includes a seat and a carriage coupled to the seat. The carriage and seat are laterally moveable together in a transverse direction relative to a forward direction of the wheelchair. In use, lateral movement of the carriage and seat outside of a wheelbase of the wheelchair enables lateral transfer of a patient to and/or from the wheelchair.

15 Claims, 18 Drawing Sheets

(56) References Cited

U.S. PATENT DOCUMENTS

| | | | | | |
|---|---|---|---|---|---|
| 4,949,408 | A | | 8/1990 | Trkla | |
| 4,966,379 | A | | 10/1990 | Mulholland | |
| 4,970,738 | A | | 11/1990 | Cole | |
| 4,997,200 | A | | 3/1991 | Earls | |
| 5,060,960 | A | * | 10/1991 | Branscumb et al. | 280/250.1 |
| 5,152,016 | A | | 10/1992 | Becker | |
| 5,154,438 | A | | 10/1992 | Barclay | |
| 5,193,633 | A | | 3/1993 | Ezenwa | |
| 5,286,046 | A | | 2/1994 | Bottemiller et al. | |
| 5,333,887 | A | | 8/1994 | Luther | |
| 5,380,034 | A | * | 1/1995 | Wilson | 280/657 |
| 5,413,367 | A | | 5/1995 | Ochiai | |
| 5,651,149 | A | | 7/1997 | Garman | |
| 5,860,664 | A | | 1/1999 | Smith | |
| 5,933,888 | A | | 8/1999 | Foster et al. | |
| 5,947,501 | A | | 9/1999 | Osborn | |
| 5,971,482 | A | | 10/1999 | Goertzen et al. | |
| 6,276,704 | B1 | | 8/2001 | Suiter | |
| 6,349,432 | B1 | | 2/2002 | Scordato et al. | |
| 6,361,267 | B1 | * | 3/2002 | Chuang | 414/539 |
| 7,487,559 | B1 | * | 2/2009 | Denosky | 5/81.1 HS |
| 7,506,387 | B1 | | 3/2009 | Scordato et al. | |
| 7,815,209 | B2 | * | 10/2010 | Porcheron | 280/304.1 |
| 2011/0304186 | A1 | * | 12/2011 | Andrews | 297/344.16 |

OTHER PUBLICATIONS

International Search Report dated Oct. 31, 2011 for International patent application No. PCT/US2011/024539 (published as WO 2011/100556 on Aug. 18, 2011). The instant application is a continuation of International patent application No. PCT/US2011/024539, which claims priority to U.S. Appl. No. 61/338,048; 8 pages.

Wy'East Medical Corporation, Totalift-II Transfer/Transport Chair Technical Service Manual; 51 pages, Jan. 19, 2011.

Barton Medical Corporation, Convertible™ H-Series brochure, Mar. 2007; 2 pages.

http://www.wyeastmed.com/, accessed on Jan. 19, 2011; 2 pages.

http://bartonmedical.com/, accessed on Jan. 19, 2011; 2 pages.

* cited by examiner

CONVERTIBLE WHEELCHAIRS WITH MOVABLE CARRIAGES FOR TRANSFERRING PATIENTS TO/FROM THE WHEELCHAIRS

CROSS REFERENCE TO RELATED APPLICATIONS

This application is a continuation of PCT International Application No. PCT/US2011/024539 filed Feb. 11, 2011, published as WO 2011/100556 on Aug. 18, 2011 which, in turn, claims the benefit of and priority to U.S. Provisional Patent Application No. 61/338,048 filed Feb. 11, 2010. The disclosures of the applications identified in this paragraph are incorporated herein by reference in their entirety.

FIELD

The present disclosure relates generally to convertible or configurable wheelchairs having movable carriages for transferring patients to/from the wheelchairs.

BACKGROUND

This section provides background information related to the present disclosure which is not necessarily prior art.

Conventional wheelchairs typically include a fixed, non-reclining seat made of a flexible material such as vinyl, canvas, or the like. The flexible material is stretched across a frame, which, in turn, is supported between front pair of wheels and a larger back pair of wheels. The larger back wheels may function as the drive wheels, while the front wheels may be in the form of relatively small front swivel casters for steering and turning the wheelchair.

Normally, conventional wheelchairs may be configured to be foldable or collapsible by drawing or bringing the opposing sides of the wheelchair's frame together, thereby reducing its overall width. When in its folded or collapsed state, the wheelchair is more easily handled and stored.

SUMMARY

This section provides a general summary of the disclosure, and is not a comprehensive disclosure of its full scope or all of its features.

According to various aspects, exemplary embodiments are disclosed of wheelchairs. In an exemplary embodiment, a wheelchair generally includes a seat and a carriage coupled to the seat. The carriage and seat are laterally moveable together in a transverse direction relative to a forward direction of the wheelchair. In use, lateral movement of the carriage and seat outside of a wheelbase of the wheelchair enables lateral transfer of a patient to and/or from the wheelchair.

Also disclosed are methods relating to patient transfers to/from wheelchairs. In an exemplary embodiment, a method generally includes laterally moving a carriage and seat of the wheelchair in a transverse direction relative to a forward direction of the wheelchair outside of a wheelbase of the wheelchair. In another exemplary embodiment, a method may generally include transferring a carriage carrying a patient laterally outside of a wheelbase of a wheelchair over tracks or rails defined by at least one armrest of a wheelchair. In a further exemplary embodiment, a method may generally include using an armrest of a wheelchair as an outrigger by contacting the armrest with a surface to/from which a wheelchair patient is being transferred, thereby allowing weight to be transferred to the surface via the armrest and providing additional stability and support for the wheelchair during patient transfer.

Further features, advantages, and areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
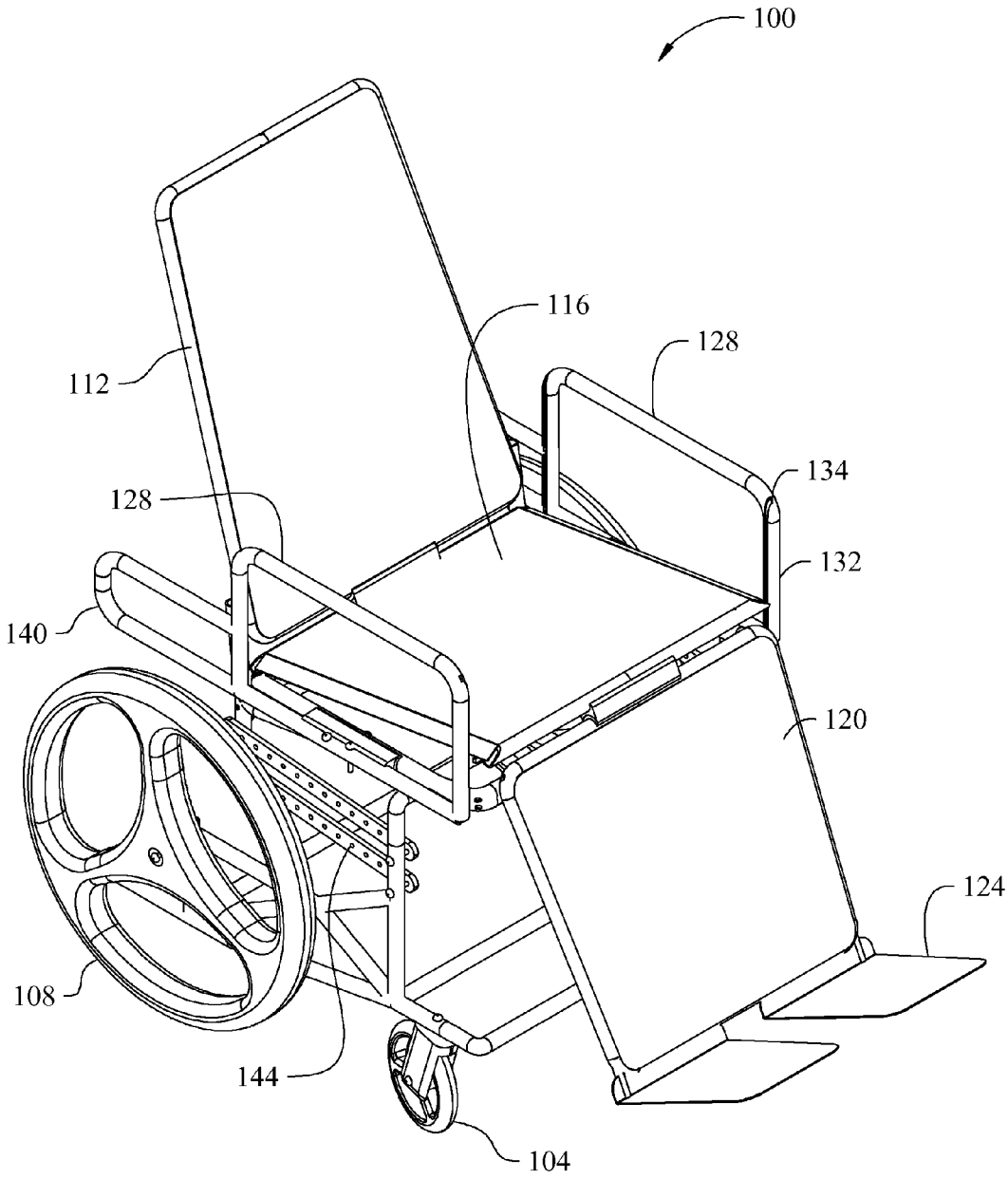
FIG. 1 is a perspective view of a wheelchair according to an exemplary embodiment of the present disclosure.
Figure 7:
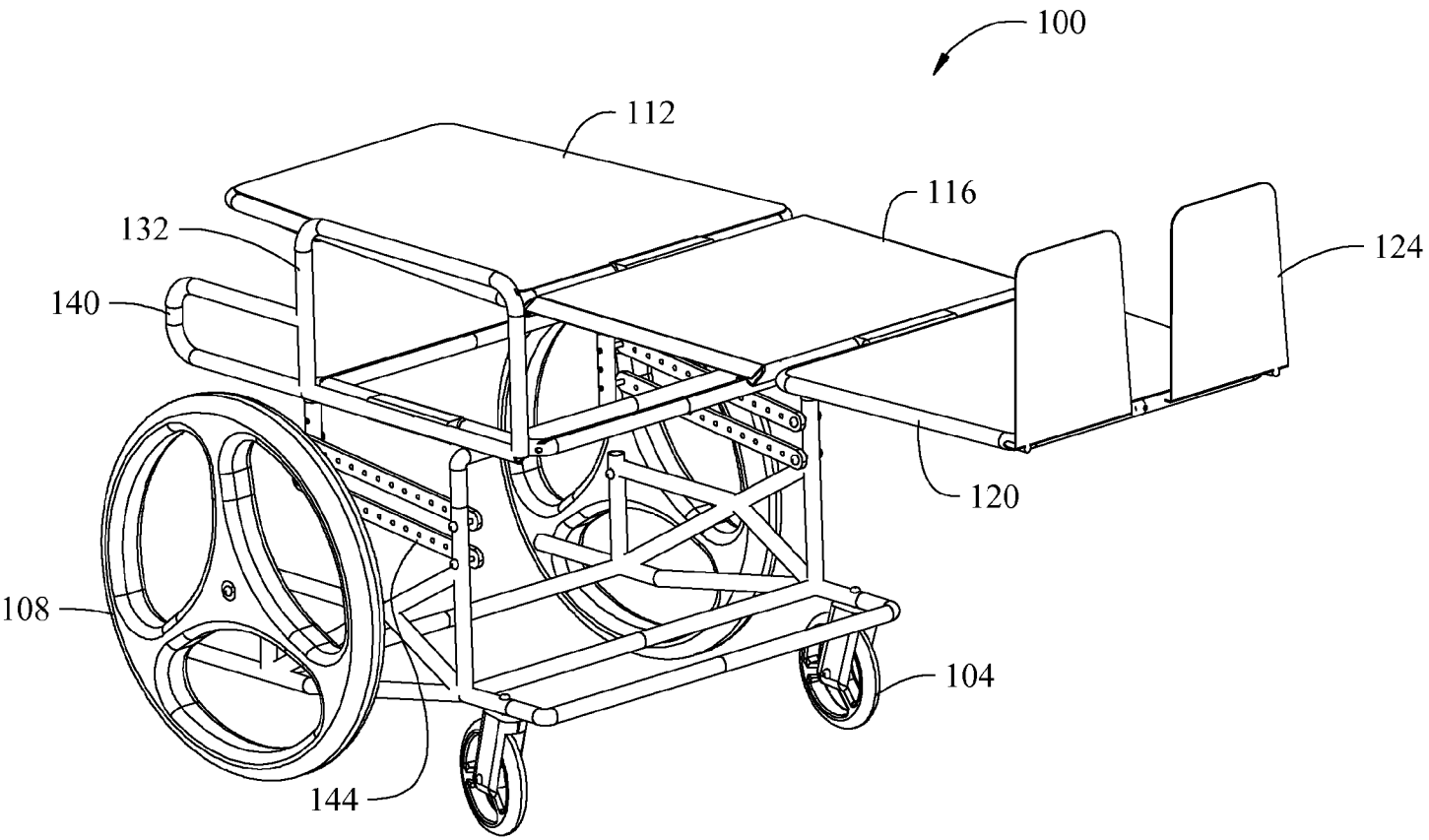
FIG. 7 is a perspective view of the wheelchair shown in FIG. 1, and illustrating the wheelchair's seat, backrest, and leg rest in a supine, flattened configuration and the movable carriage (including the seat, backrest, and leg rest) has been moved along the folded down side rail or armrest, for patient transfer to/from the wheelchair in a supine, lying down position.
Figure 7A:
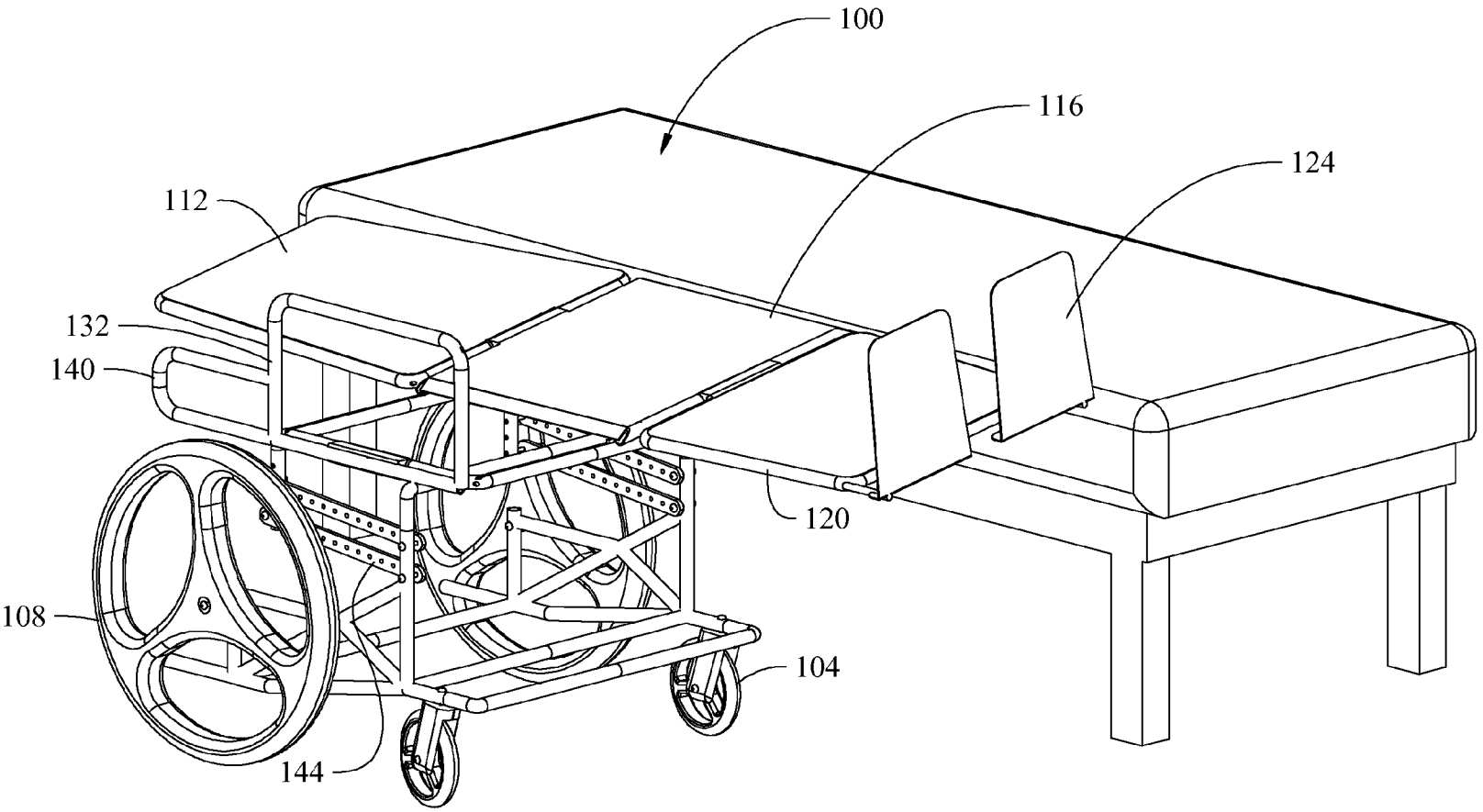
Figure 8:
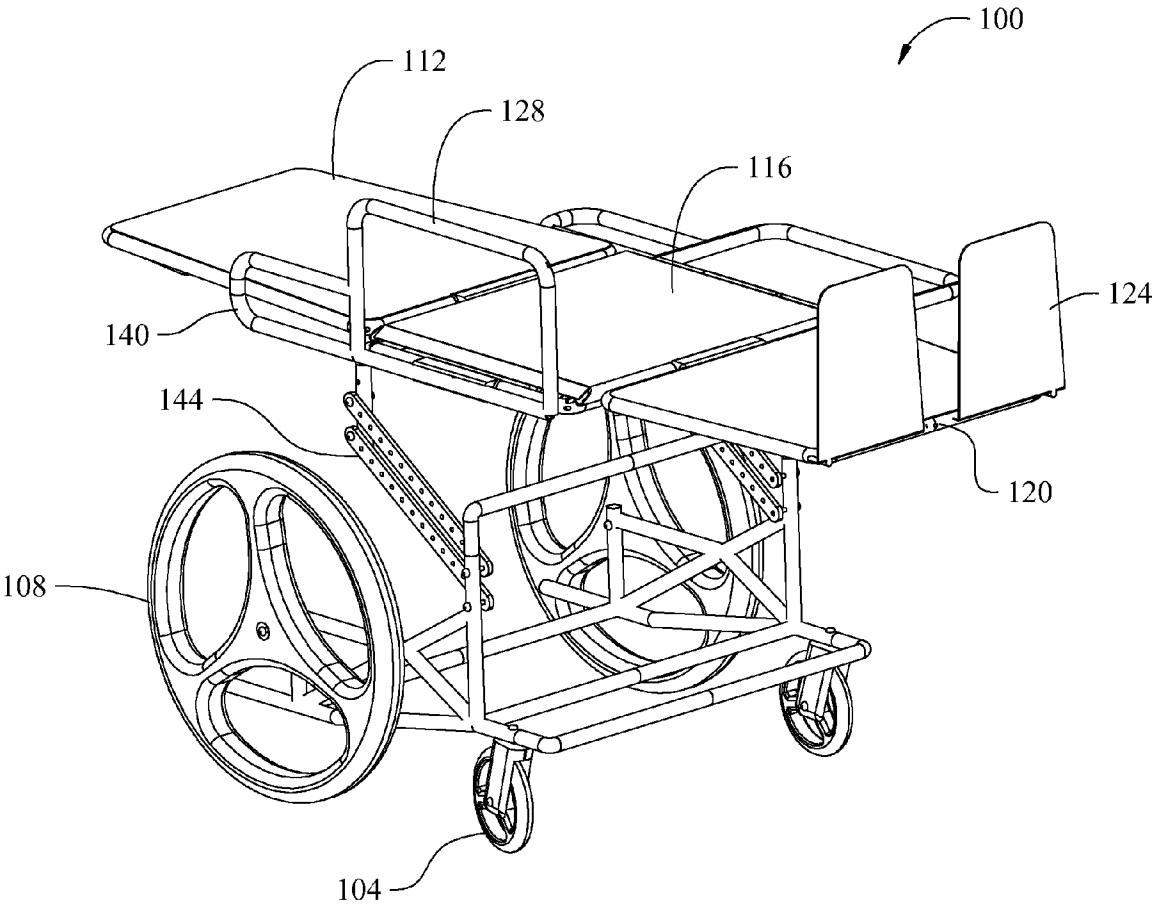
Figure 9:
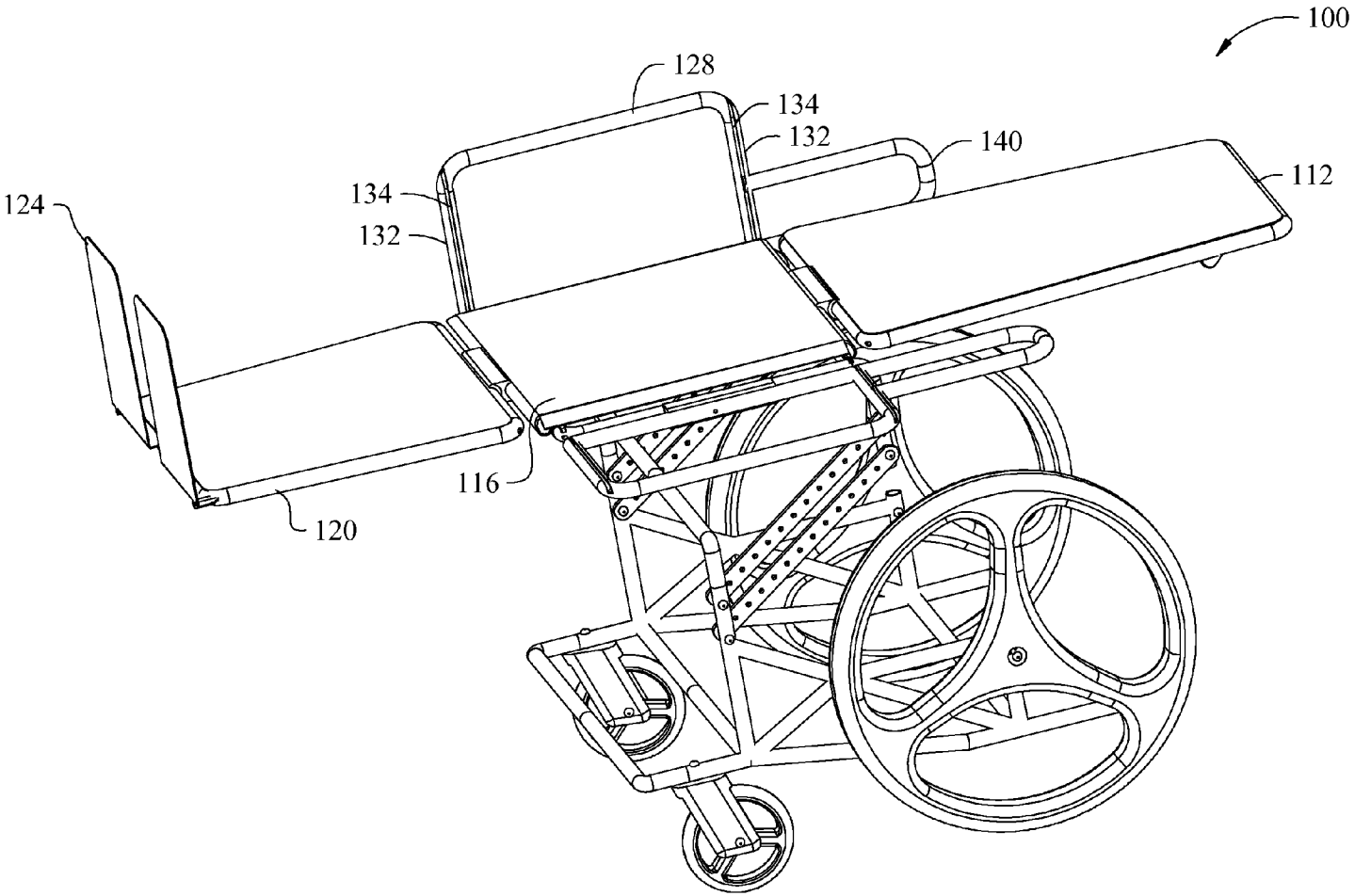
Figure 10:
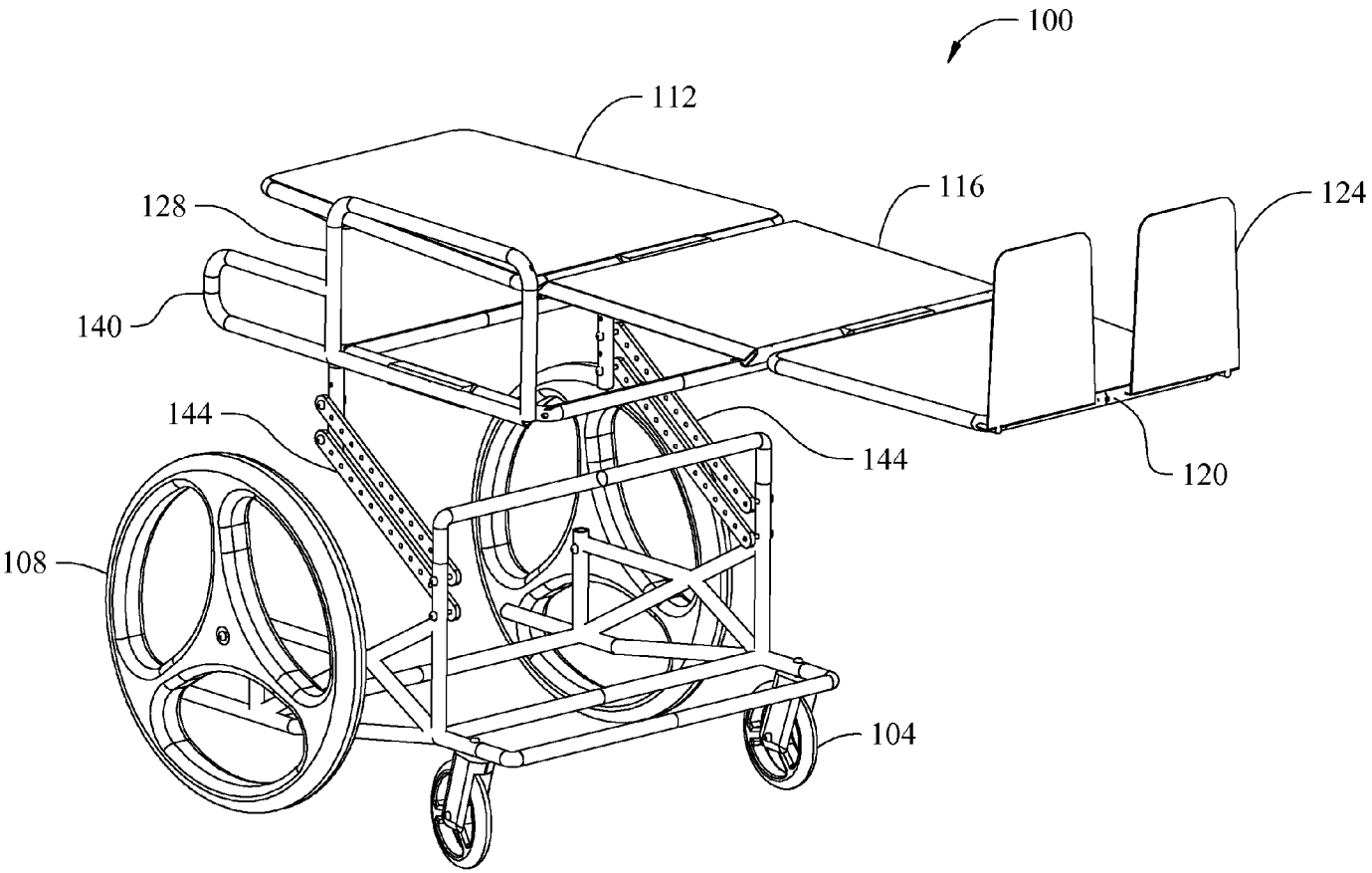
Figure 10A:
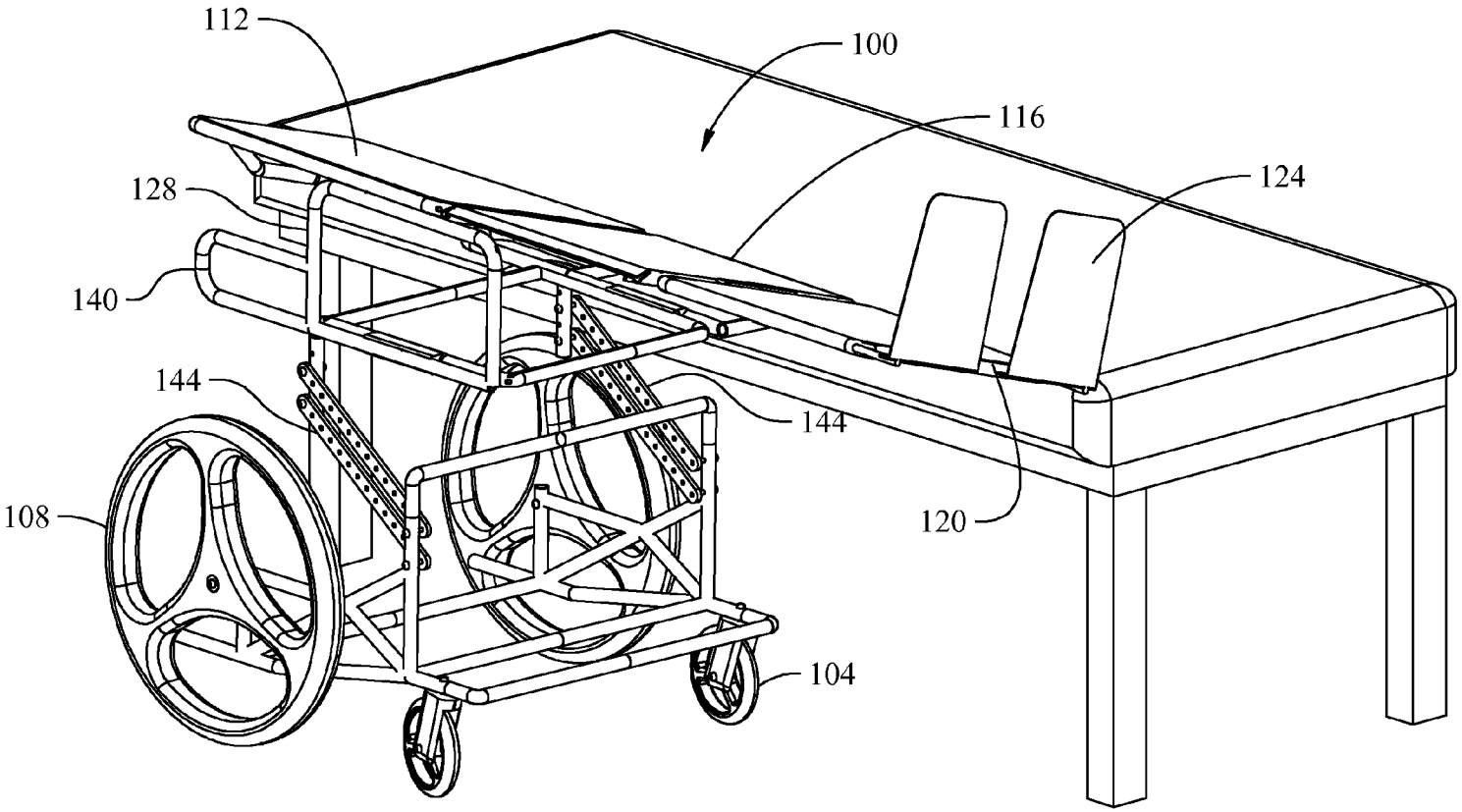
Figure 11:
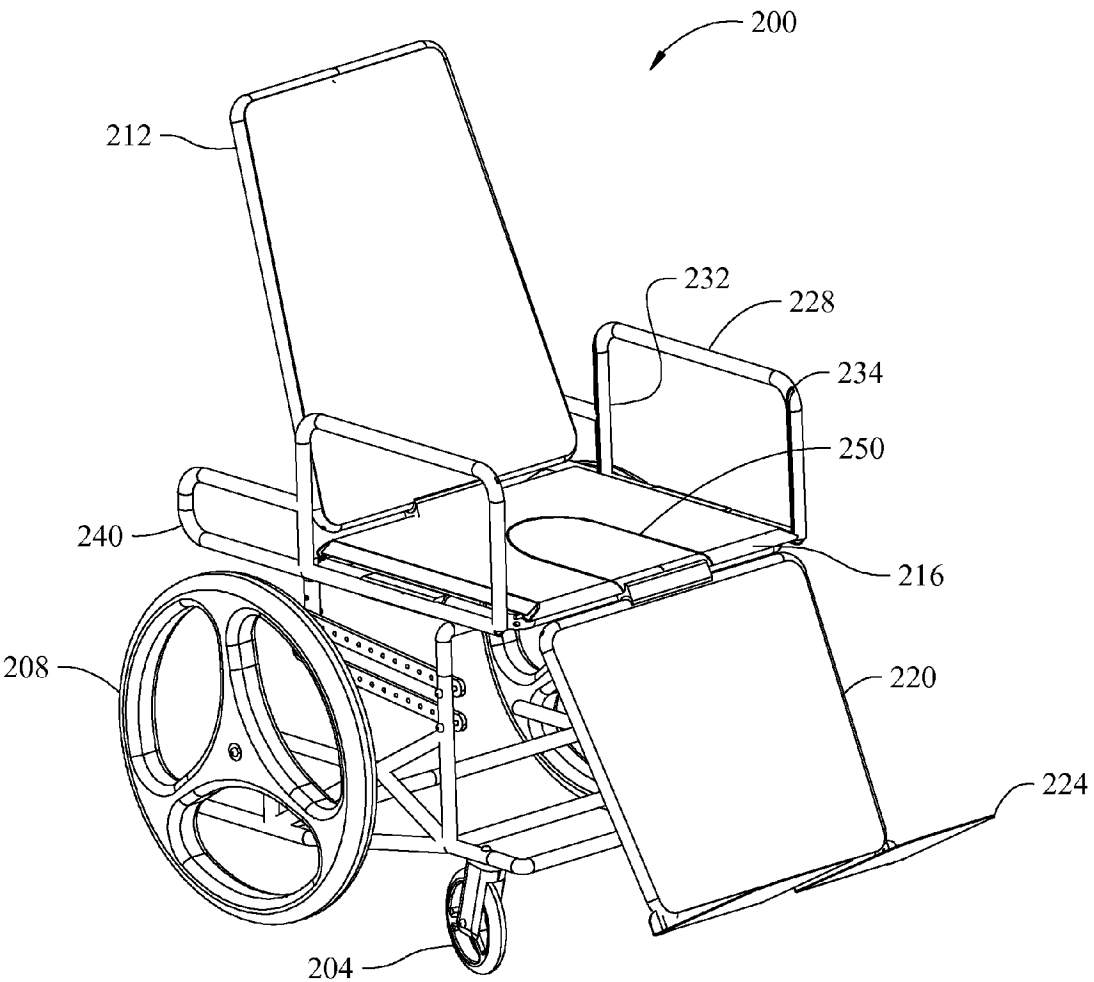
Figure 12:
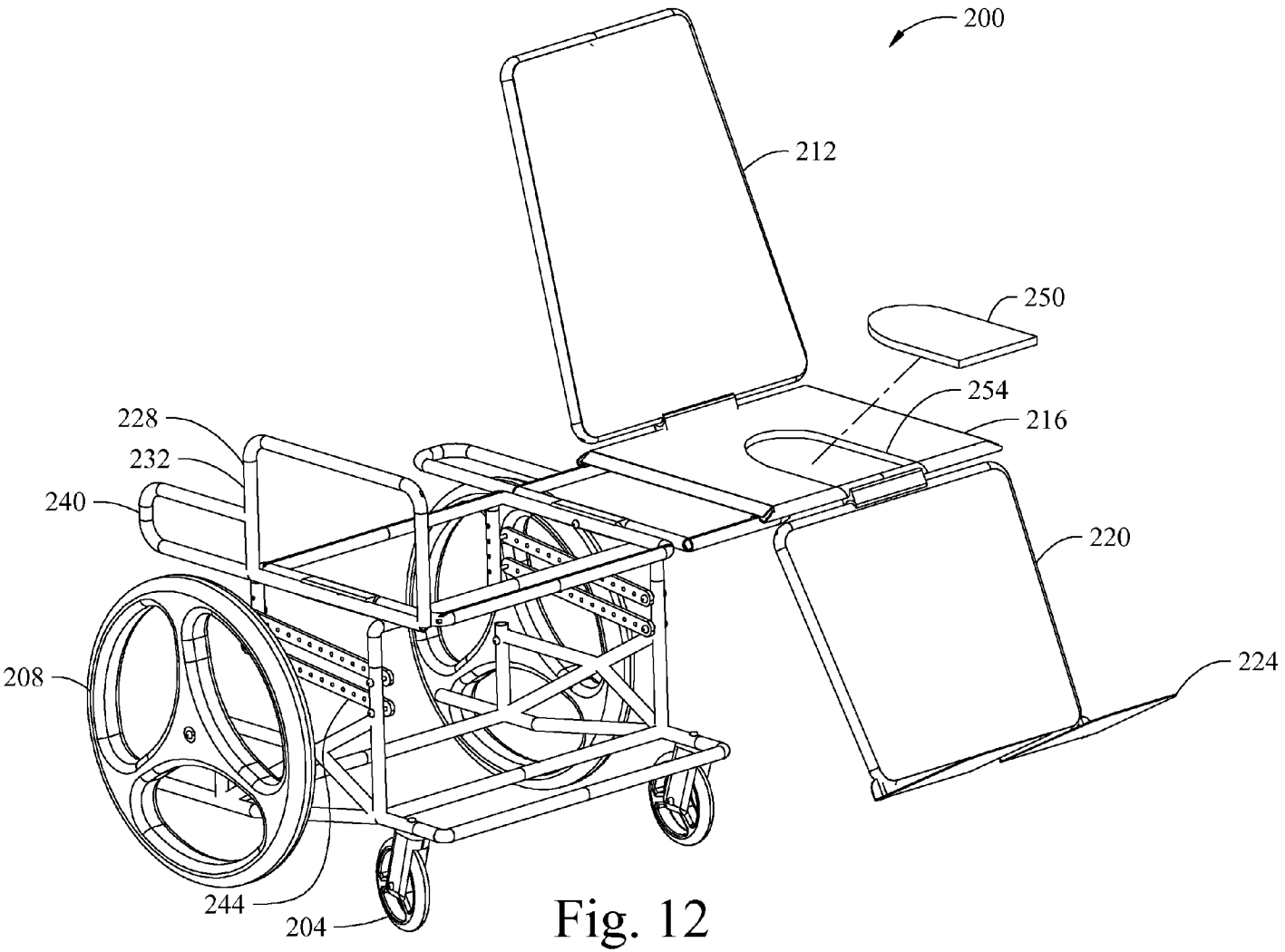
Figure 13:
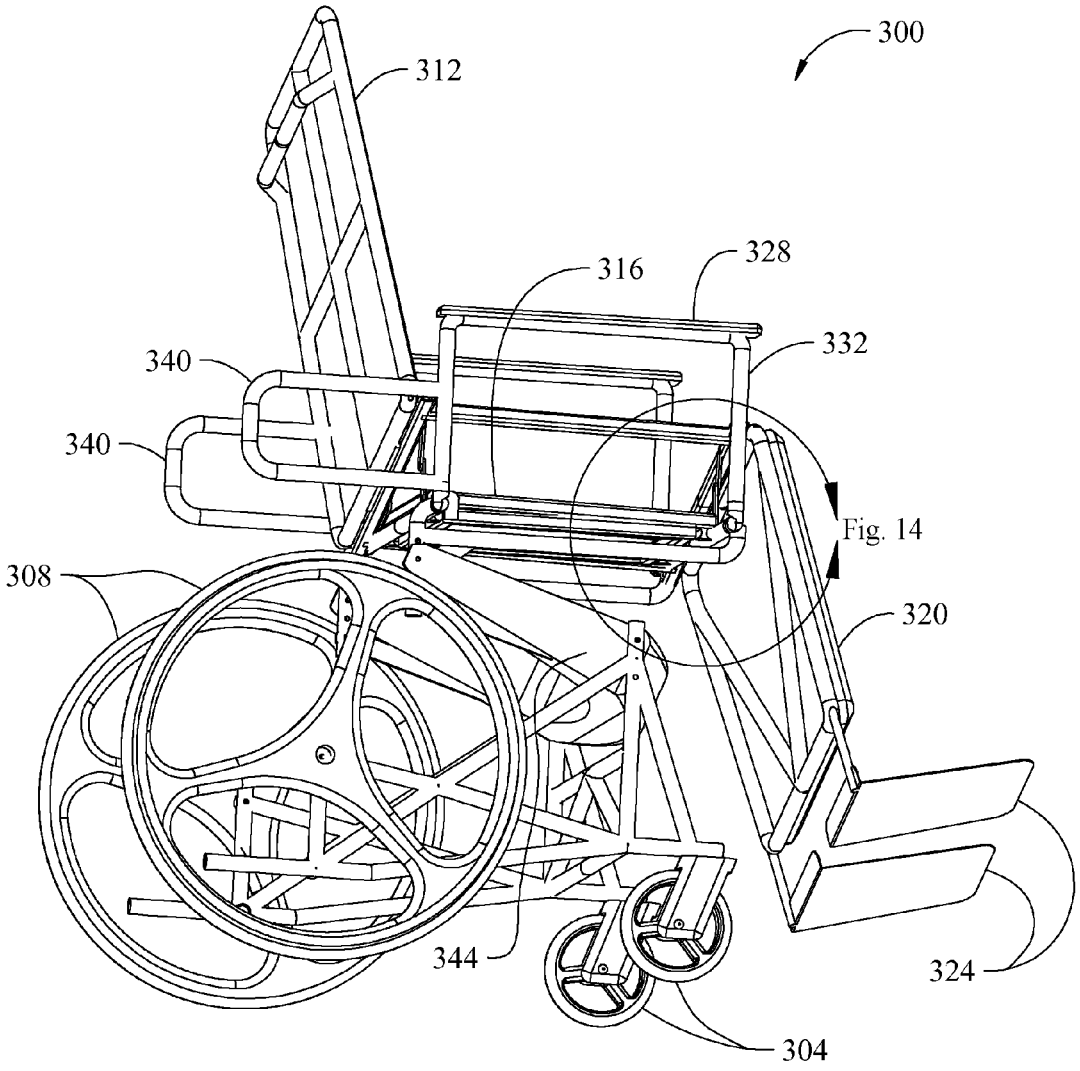
Figure 14:
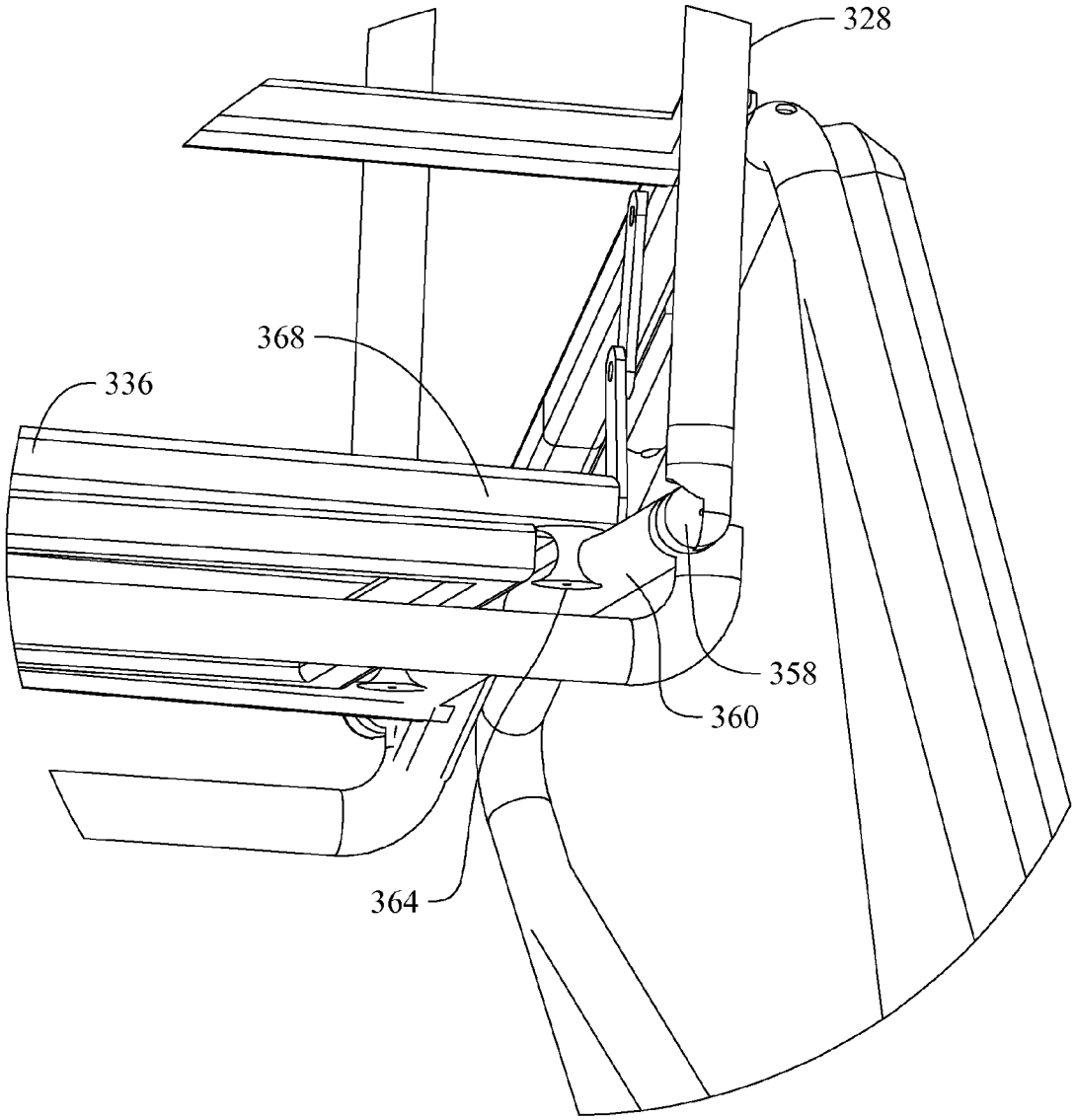
Figure 15:
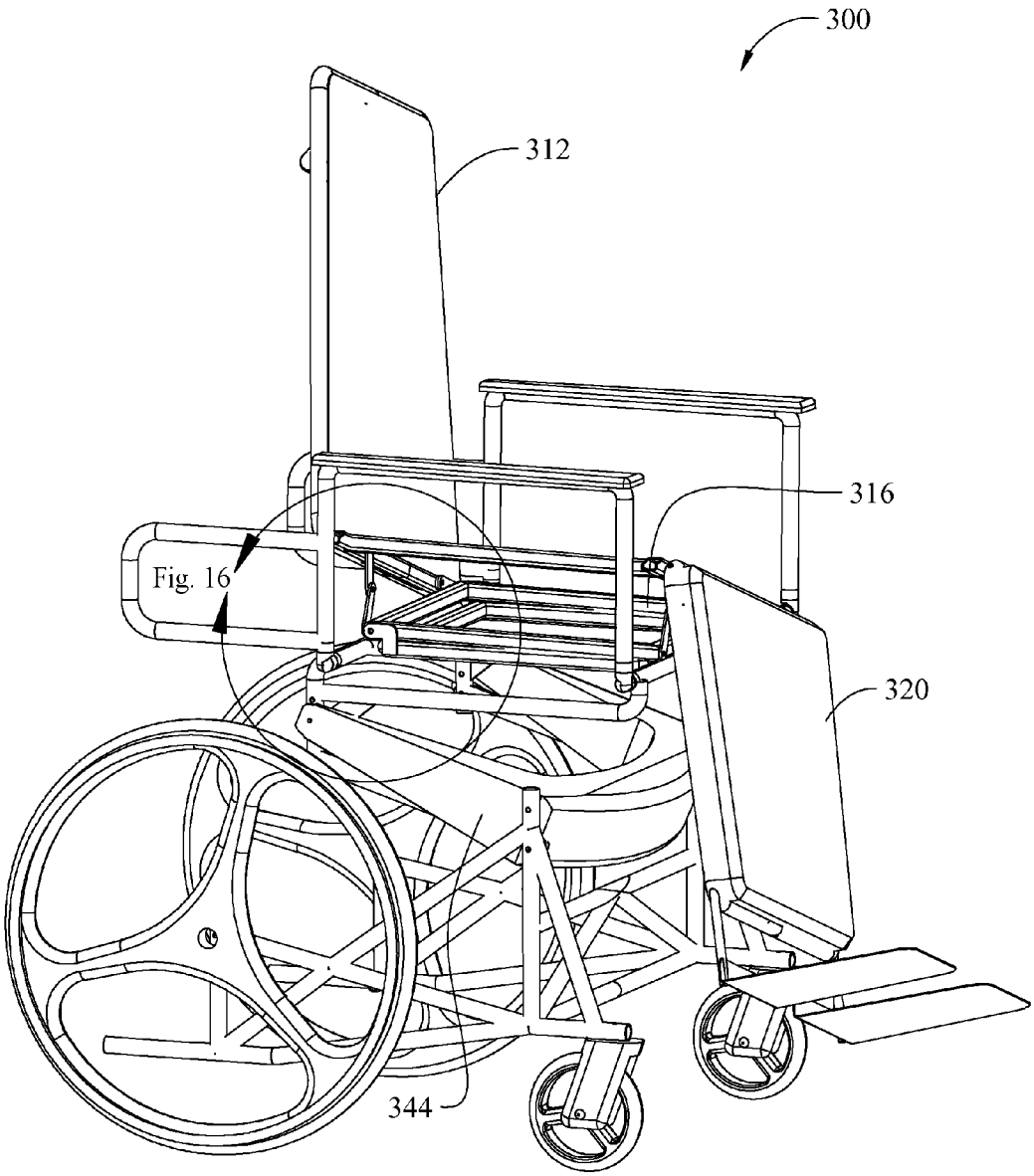
Figure 16:
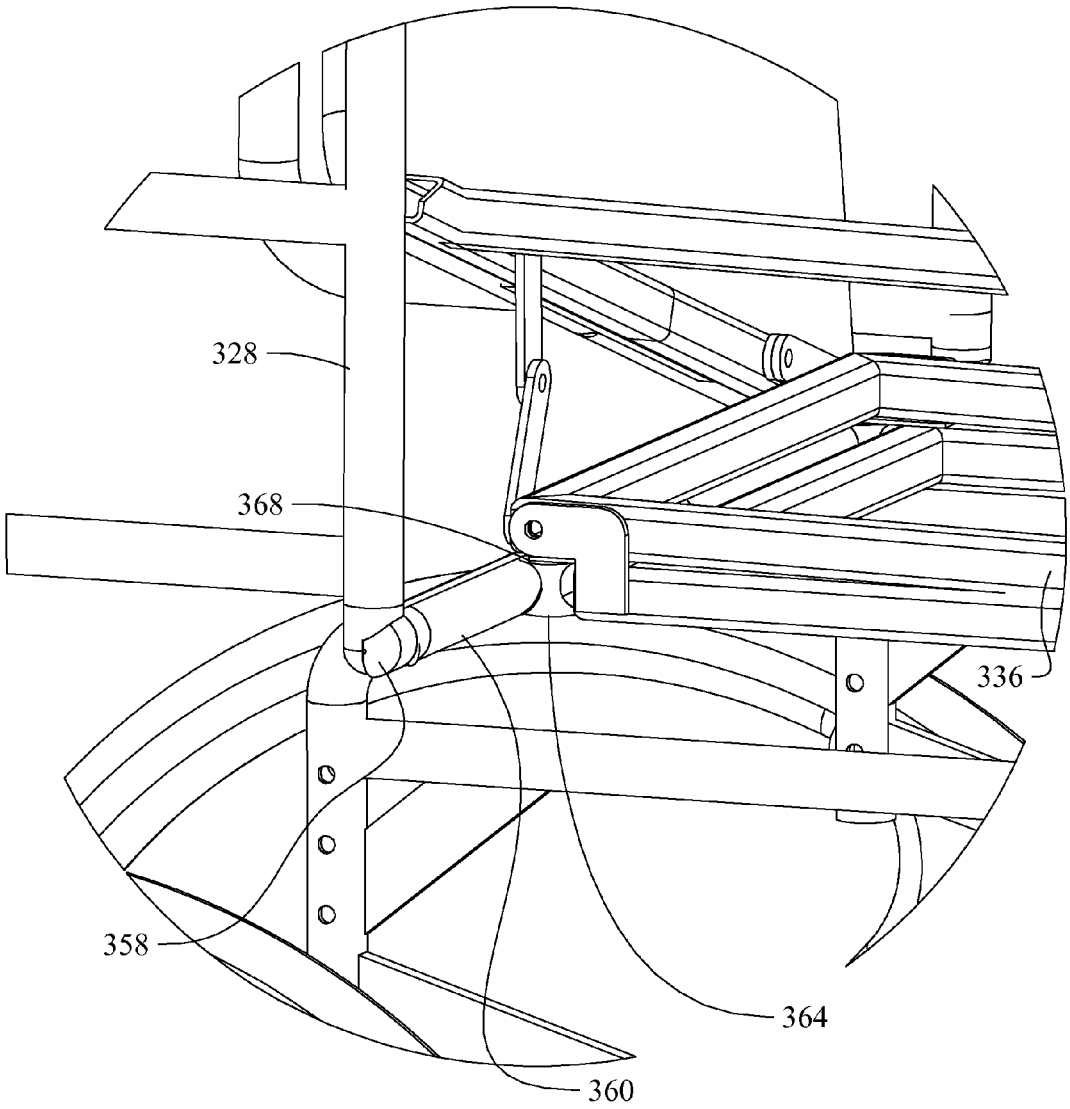

FIG. 7A is a perspective view of the wheelchair shown in FIG. 7, and illustrating the wheelchair positioned next to a bed and after the wheelchair's flattened deck defined by the seat, backrest, and leg rest have been pivoted or tipped so that the wheelchair deck is inclined or downwardly slanted/sloped below the bed, which may allow a patient to be more easily downwardly slid or rolled off the bed onto the flattened deck of the wheelchair, thus facilitating a smoother re-loading back onto the wheelchair deck;

FIGS. 8 and 9 are perspective views of the wheelchair shown in FIG. 1 with the wheelchair's seat, backrest, and leg rest shown in a supine, flattened configuration, and also illustrating the wheelchair's seat assembly (seat, backrest, leg rest, side rails or armrests, frame portions) lifted or raised upward before the movable carriage has been moved along the folded down side rail or armrest;

FIG. 10 is a perspective view of the wheelchair shown in FIG. 9, after the movable carriage has been moved along the folded down side rail or armrest, for patient transfer to/from the wheelchair;

FIG. 10A is a perspective view of the wheelchair shown in FIG. 10, and illustrating the wheelchair positioned next to a bed and after the wheelchair's flattened deck defined by the seat, backrest, and leg rest have been pivoted or tipped so that the deck is inclined or downwardly slanted/sloped above the bed, which may allow a patient to be more easily downwardly slid or rolled off the wheelchair's flattened deck onto the bed, thus facilitating a smoother unloading off the wheelchair deck onto the bed;

FIG. 11 is a perspective view of a wheelchair having a removable seat section, e.g., for toilet access, according to another exemplary embodiment of the present disclosure;

FIG. 12 is a perspective view of a wheelchair shown in FIG. 11, after the removable seat section has been removed and the movable carriage has been moved along the folded down side rail or armrest;

FIG. 13 is a perspective view of a wheelchair according to another exemplary embodiment of the present disclosure, wherein the seat cushion or padding has been removed, for example, to illustrate the framework or frame assembly of the wheelchair;

FIG. 14 is a perspective view of the designated portion of the wheelchair shown in FIG. 13;

FIG. 15 is another perspective view of the wheelchair shown in FIG. 13; and FIG. 16 is a perspective view of the designated portion of the wheelchair shown in FIG. 15.

DETAILED DESCRIPTION

Example embodiments will now be described more fully with reference to the accompanying drawings.

The inventors disclose herein various exemplary embodiments of wheelchairs that are configured to facilitate the transfer (e.g., lateral transfer, etc.) of patients/users to and/or from the wheelchairs, such as the transfer of a patient from the wheel chair to a bed, gurney, toilet, bathtub, or vice versa. In an exemplary embodiment, a wheelchair generally includes a carriage mechanism that can laterally transfer a patient over or along a path (e.g., tracks, etc.) via wheels, rollers, bearings, slide rails, etc.

Also disclosed herein are exemplary methods of transferring (e.g., laterally transferring, etc.) a patient to/from a wheelchair by using a carriage that is movable (e.g., slidable, rollable, etc.) over and/or along at least a portion of a side rail or armrest of the wheelchair, which has been converted (e.g., rotated, folded down, repositioned, etc.) from a first configuration or position (e.g., generally vertical or upright, etc.) position to a second configuration or position (e.g., generally horizontal or parallel with wheelchair seat, etc.). An exemplary method may include transferring a carriage carrying a patient laterally over or along tracks created by folding, pivoting, repositioning or otherwise converting at least one armrest or side rail of the wheelchair. In this example, the carriage may traverse over or along the tracks that are incorporated into, integral to, or built into or on either or both of the side rails and/or armrests of the wheelchair. During such method, the patient may be laterally transferred by the carriage while in a sitting or seated upright position, in a semi-sitting position (legs flat and upper body mostly upright), or in a supine or laying down position.

In an example transfer process, the patient may be in a sitting or seated upright position as the carriage (and the patient thereon) is being laterally transferred e.g., slid along tracks or other sliding path defined by the converted side rail or armrest. In this example, the carriage (and the patient thereon) may be moved in a left or right sideways direction generally perpendicular to the forward or rearward direction of travel of the wheelchair. Stated differently, the carriage may be movable in a sideways direction that is generally parallel to the axis of rotation of the rear wheels of the wheelchair in this example.

After the carriage has reached or is adjacent to the end of the tracks or sliding path, the patient may then be moved to a supine position by adjusting the back rest of the wheelchair and moved or transported to a bed or other location. As another example transfer process, the patient may be in a sitting or seated upright position as the carriage is being laterally transferred, e.g., slid, rolled, etc. along at least a portion, e.g., tracks, of the folded or converted side rail or armrest. After the carriage has reached the end of the tracks or sliding path, the patient may then remain in the sitting position and be transferred from the wheelchair onto a toilet or other location, and vice versa.

In an exemplary embodiment, a wheelchair includes one or more side rails or armrests, which may be folded down and locked into a generally horizontal position that is also generally parallel to the seat (not including the backrest) of the wheelchair. Configuring or converting the armrest/side rail to the horizontal position enables the carriage (and seat assembly coupled thereto) to be movable there along for transferring weight. The folded down armrest may also establish an additional support point, similar to the manner in which an outrigger functions. In such embodiment, the wheelchair may be sized with a width and length similar to a standard wheelchair yet still be stable enough for patient transfers to/from a bed, toilet, shower seat, etc. without outriggers or additional stabilizers as the inventors' wheelchair may instead use one of the armrests in conjunction with the bed, toilet, shower seat, etc. itself as an additional point of stability.

In some embodiments, the carriage and entire seat assembly (including the seat, backrest, leg rest) may be raised or lowered (e.g., manually, automatically via electrical or pneumatic power, etc.) for transferring to/from the wheelchair at varying height, such as to/from a bed (or other location in a hospital, residential home, nursing home, etc.) that is higher or lower than the seat of the wheelchair beds. When loading and unloading with the armrest or side rail extended outwardly or folded down in the horizontal position, the armrest or side rail may have some flex in it to accommodate variations in compression of the bed, gurney, or other location to which the patient is being transferred.

The side rail/armrest of a wheelchair may be folded relatively flat such that the side rail/armrest horizontally swings out to a horizontal position and locks into place. At which point, the side rail/armrest thus enables the seat and carriage to traverse laterally while also transferring weight from the wheelchair to a bed or other such location to which the patient is to be transferred. In turn, the bed or other support structure may provide additional stability and support for the wheelchair during patient transfer. This means that weight can thus be transferred via the wheelchair's armrest or side rail to the bed, gurney, toilet, or other structure to which the patient is being transferred to or from, thus providing additional stabilization during the transfer and while the wheelchair is in the second, transfer mode configuration. Alternatively, this may be accomplished with the entire seat carriage facilitating an uneven lift or compression such that the entire seat housing, rails, etc. can adjust or tip slightly to adjust to uneven surfaces or uneven surface compression (e.g., bed, etc.).

Exemplary embodiments of the wheelchairs disclosed herein may be configured so as to provide such patient transfer/transport functions while being sized dimensionally (e.g., width, length, and/or height) similar to a conventional, standard wheelchair that are commonly used in homes, hospitals, or similar setting. With the similar sizing, the inventor's exemplary embodiments may thus be electrically powered and/or driven by similar means as standard, conventional wheelchairs. Accordingly, the inventors' wheelchairs may thus be operated and function (e.g., be reclined or flattened, seat tilt, collapsible for storage, etc.) like conventional, standard wheelchairs but, with the significantly improvement patient transfer means disclosed herein. By way of example, exemplary embodiments of the inventors' wheelchairs may include a backrest, seat, and leg rest that are configurable into a flattened, supine configuration and/or reclined configuration in which the backrest and seat are tipped to, for example, improve patient comfort. Advantageously, the inventors' disclosed exemplary embodiments of wheelchairs enable patient transfers from the wheelchair to a bed, gurney, toilet, etc., and then back to the wheelchair again, for example, with the assistance of just a single caregiver or with no caregiver assistant for more able patients. The inventors' exemplary embodiments of wheelchairs disclosed herein may be used in various environments (e.g., home, nursing home, long term care facility, hospital, etc.) by patients having different needs for a wide range of types of transfers (e.g., to beds, gurneys, toilets, bathtubs of varying heights, etc.).

Depending on the intended user of the wheelchair, exemplary embodiments may be non-powered such that the patient/user, caregiver, etc. must manually cause the carriage to be moved along the path defined or provided by the folded down side rail/armrest. For example, these non-powered wheelchair embodiments may be used by more able bodied and/or independent uses/patients. The non-powered wheelchair embodiments may be relatively light and readily maneuverable with manual wheel drive by the user. For less independent or less able bodied patients/users, exemplary embodiments of the inventors' wheelchairs may be configured to provide more fully powered transport and transfers.

In some exemplary embodiments, a wheelchair may be configured such that the seat, carriage, and/or tracking assembly as a whole might adjust in relative position and angle from level (during normal lift and decent, and lateral transfer) to permit some degree of tipping to accommodate, for example, a bed that sags in the middle. The carriage or transport assembly might create such an adjustment (from perfectly level or horizontal) by employing or varying the amount of lift delivered on the left side versus the right side of the wheelchair in an exemplary embodiment. Such flexibility in the seat platform and lateral transport can also facilitate exits from and re-entries onto the wheelchair seat or bed in the sitting position and/or supine, prone position.

By way of example, a wheelchair may also include a lifting mechanism or means for raising and lowering the seat assembly (e.g., seat, backrest, leg rest, side rails and armrests), for example, to accommodate different or varying heights of beds, gurneys, etc. In such embodiments, the lifting mechanism may be manually operated/powered (e.g., with a manual crank, etc.) or electrically, pneumatically, etc. powered. For example, a wheelchair may include a lifting mechanism that includes hydraulic means, electric motor, gears, scissor lift, and/or electric pumps. Alternative embodiments may not include any such powered or manual lifting mechanisms.

Exemplary embodiments include an integrated transport track and armrest/side rail, which provides versatility of patient transfers and enables the use of full size wheels. The armrests or side rails are an integral part of the lateral transfer/transport as explained herein by folding then locking down, for example, to transfer weight to the bed during transport to further stabilize the chair. This armrest design enables stable and safe transports even with gaps to transport over, and is actually integral in facilitating the full-sized wheel to be used (e.g., avoiding the need to "swing" or "drop" the armrest out of the way). It also functions similar to that of an "outrigger" and provides stability, thereby helping to ensure safe, secure transfers even when the wheelchair is configured with a standard width wheelbase.

Accordingly, the inventors' have disclosed herein exemplary embodiments of wheelchairs that facilitate patient/user transfers to enable a single caregiver (of no particular strength) to quickly transfer a wheelchair patient/user from the wheelchair to the bed, etc. and back quickly. For more able patients/users, the inventors' wheelchairs may be used by such able bodied patients/users that may be transferred to/from the wheelchairs without any caregiver assistance. As disclosed herein, the inventors' wheelchairs use a dramatically different approach to move patients to/from the wheelchairs. For example, patient/user transfers may be accomplished in exemplary embodiments disclosed herein without the use of lifts, slings, or dragging on plastic sheets or bedding. With the inventors' wheelchairs, patient/user transfers to/from the wheelchair may be accomplished in a fast, safe, cost effective, and energy efficient way whether the patient/user is either sitting or lying down.

With reference to the figures, FIGS. 1 through 10 illustrate an exemplary embodiment of a wheelchair 100 embodying one or more aspects of the present disclosure. As shown, the wheelchair 100 includes a pair of front wheels 104 and a pair of back wheels 108. In this example, the back wheels 108 are larger (e.g., have a diameter of about 20 to 24 inches, etc.) than the front wheels 104. The front wheels 104 are in the form of relatively small front swivel casters for steering and turning the wheelchair 10. Accordingly, this illustrated embodiment may be self-propelled or powered by the patient/user in the traditional method of using one's hands to propel the wheels to move and steer the wheelchair 100. Alternative embodiments may include differently configured wheels (e.g., larger or smaller wheels, etc.) and/or the wheelchair may be electrically powered in other embodiments.

The wheelchair 100 also includes a backrest 112, seat 116, leg rest 120, and feet supports 124. As shown by a comparison of FIGS. 1, 4, and 7, the wheelchair 100 is configurable into a first sitting, normal operating configuration (FIG. 1), a second feet-up configuration (FIG. 4), and a third flattened, supine configuration (FIG. 7), for example, improve patient comfort. In some embodiments, the flattened deck defined by the horizontally aligned backrest 112, seat 116, and leg rest 120 may also be configured to tip or rotate (e.g., about an axis perpendicular to the rotational axis of the back wheels 108) to provide an inclined or slanted surface to help facilitate patient transfer to/from wheelchair 100 and bed, etc.

For example, FIG. 10A illustrates the deck defined by the backrest 112, seat 116, and leg rest 120 after being tipped or pivoted so that the deck is inclined or downwardly slanted above the surface to which the patient is being transferred such that the patient may thus be downwardly slid or rolled down the wheelchair's sloped or slanted deck onto a bed, gurney, table, or other support surface. The downward slant or slope of the wheelchair deck facilitates a smoother unloading of a patient off the wheelchair deck onto the bed. Conversely, FIG. 7A illustrates the wheelchair deck defined by the backrest 112, seat 116, and leg rest 120 after having been tipped or pivoted so that the deck is inclined or downwardly slanted below the surface from which a patient is being transferred such that the patient may be downwardly slid or rolled off a bed, gurney, table, or other support surface onto the wheelchair sloped or slanted deck. The downward slant or slope of the wheelchair deck facilitates a smoother re-loading of a patient from the bed onto the wheelchair deck. In alternative embodiments, the surface of the wheelchair deck might have a skin or outer portion that can rotate to function much like a tank tread or conveyor belt to assist in transferring the patient to/from the wheelchair deck.

The wheelchair 100 may also be configurable into a collapsed configuration, e.g., for storage, by drawing or bringing the opposing sides of the wheelchair's frame together, thereby reducing its overall width.

Figure 2:
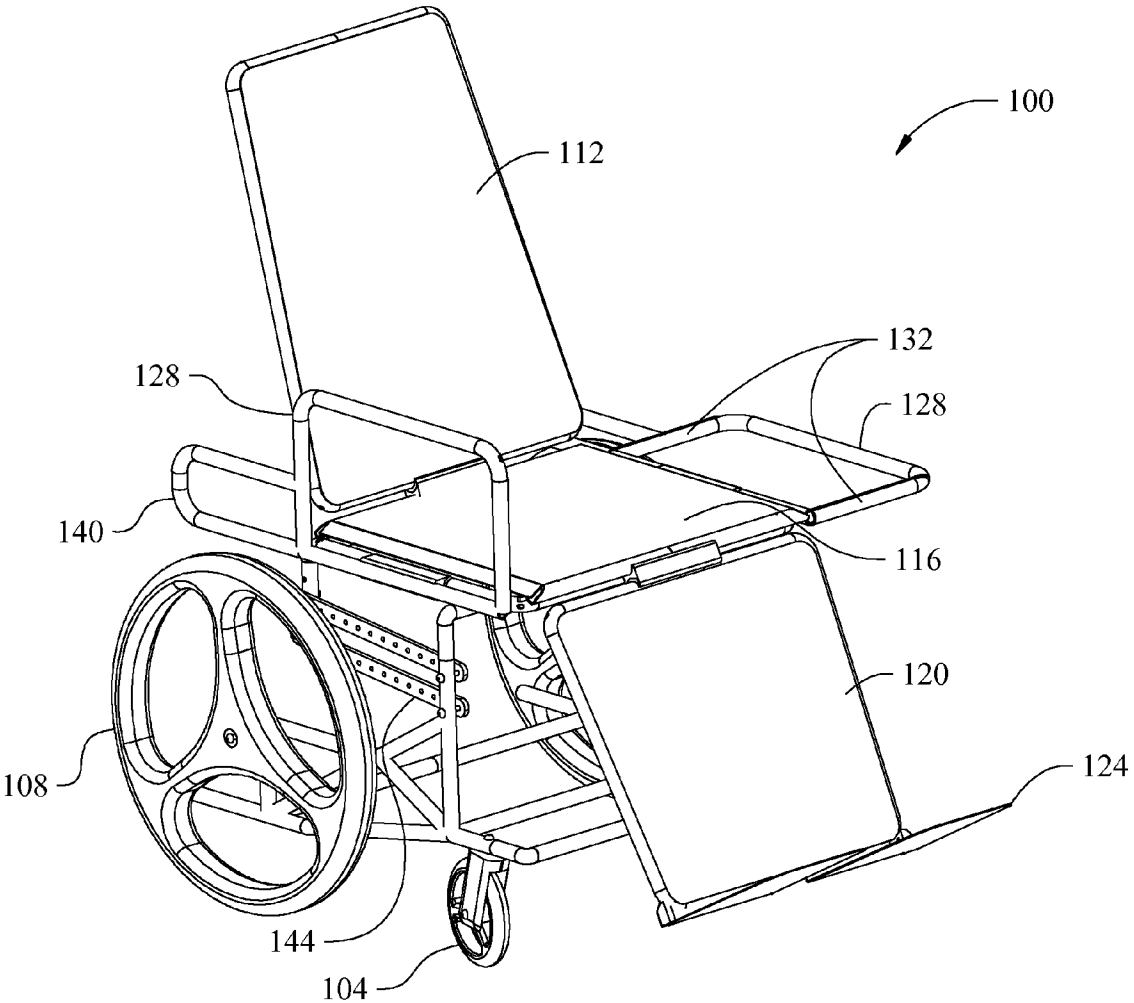
FIG. 2 is a perspective view of the wheelchair shown in FIG. 1, after a side rail or armrest of the wheelchair has been converted (e.g., folded down, etc.) from the upright configuration (shown in FIG. 1) to a generally horizontal configuration.

The wheelchair 100 includes armrests or side rails 128 on both sides. As shown by FIGS. 1 and 2, the armrests 128 are convertible from a first, normal use configuration (FIG. 1) to a second, transport configuration (FIG. 2). In the first, normal use configuration, the armrest 128 is generally upright and vertical relative to the seat 116, and inhibits or blocks sliding motion of the carriage 136. In the second, transport configuration, the armrest 128 has been rotated, pivoted, folded, repositioned, etc. downward from its upright configuration to be non-vertical, generally horizontal and parallel with the seat 116.

The armrests 128 include frame portions or sections 132 that depend (e.g., extend downwardly in FIG. 1) and support the armrest upper portions. In use, a patient's arms may rest against the upper portions. In this embodiment, the frame portions 132 of the armrests 128 include or integrally define tracks or grooves 134 along or over which may be moved the carriage 136.

Figure 3:
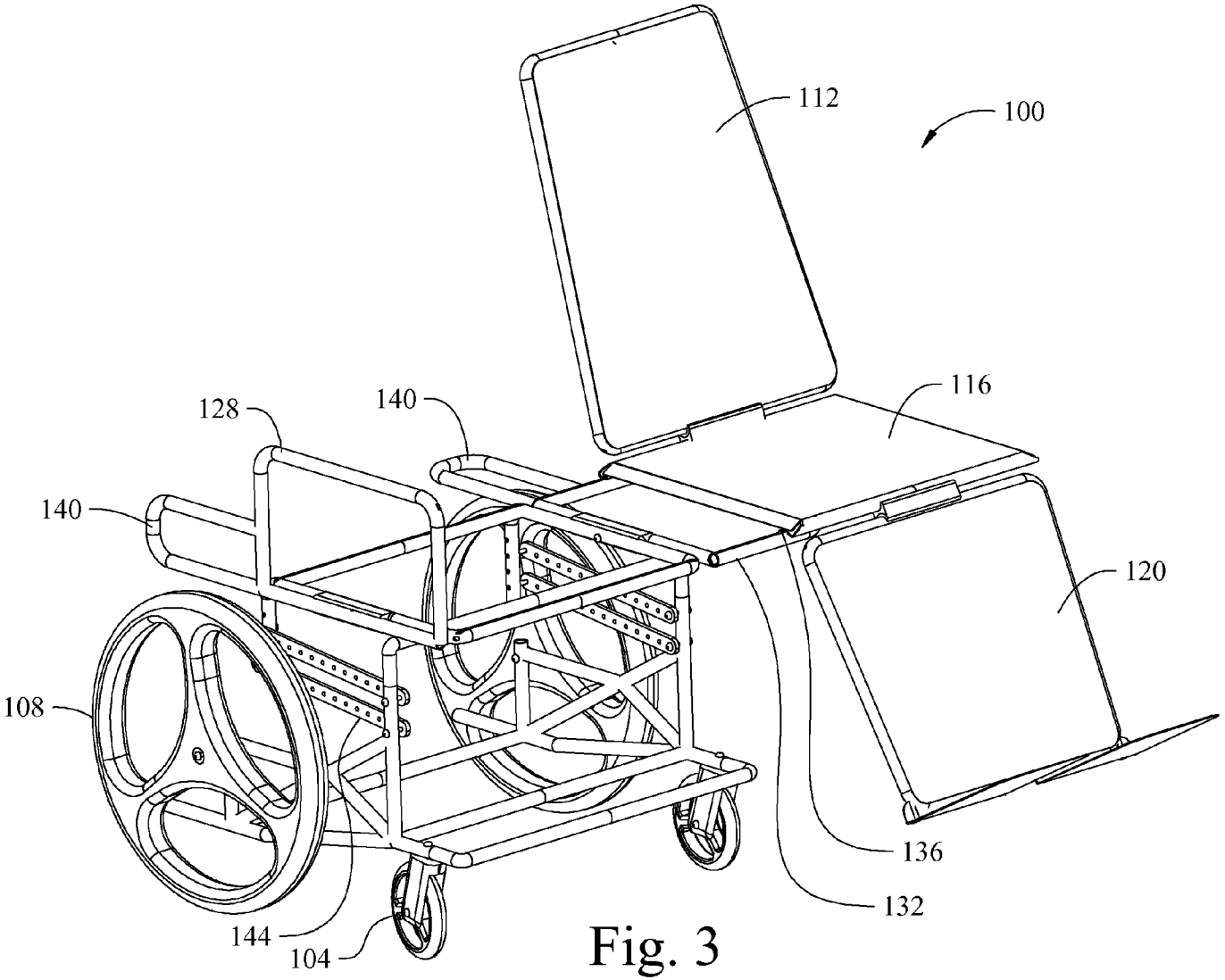
FIG. 3 is a perspective view of the wheelchair shown in FIG. 2, after the movable carriage (including the seat, backrest and leg rest) has been moved along the main rails (under the seat) and across a portion of the folded down side rail or armrest, for patient transfer to/from the wheelchair.

As shown by a comparison of FIGS. 2 and 3, the seat 116 is coupled to and supported by the carriage 136, such that the seat 116 (and thus patient sitting thereon) is moved along with the carriage 116 as it travels or traverses across the tracks 134 of the armrest 128. In FIG. 3, the carriage 136 and seat assembly are shown outside the wheelbase of the wheelchair 100. After a patient has been transferred to/from the wheelchair 100, the carriage 136 (and seat assembly) may then be slid back over the folded down armrest 128 to return to its initial position (FIG. 2), e.g., centered generally between the back wheels 108 without a patient after a patient has been transferred from the wheelchair 100 or with a patient when transferring a patient back to wheelchair 100.

In this embodiment, the tracks 134 are integrally defined or integral portions of the frame sections 132. In alternative embodiments, the tracks may, for example, be separate components that are attached to an armrest. As another example, the tracks may be housed or mounted on a flat surface or material mounted within and attached to the perimeter of the armrest frame.

Figure 6:
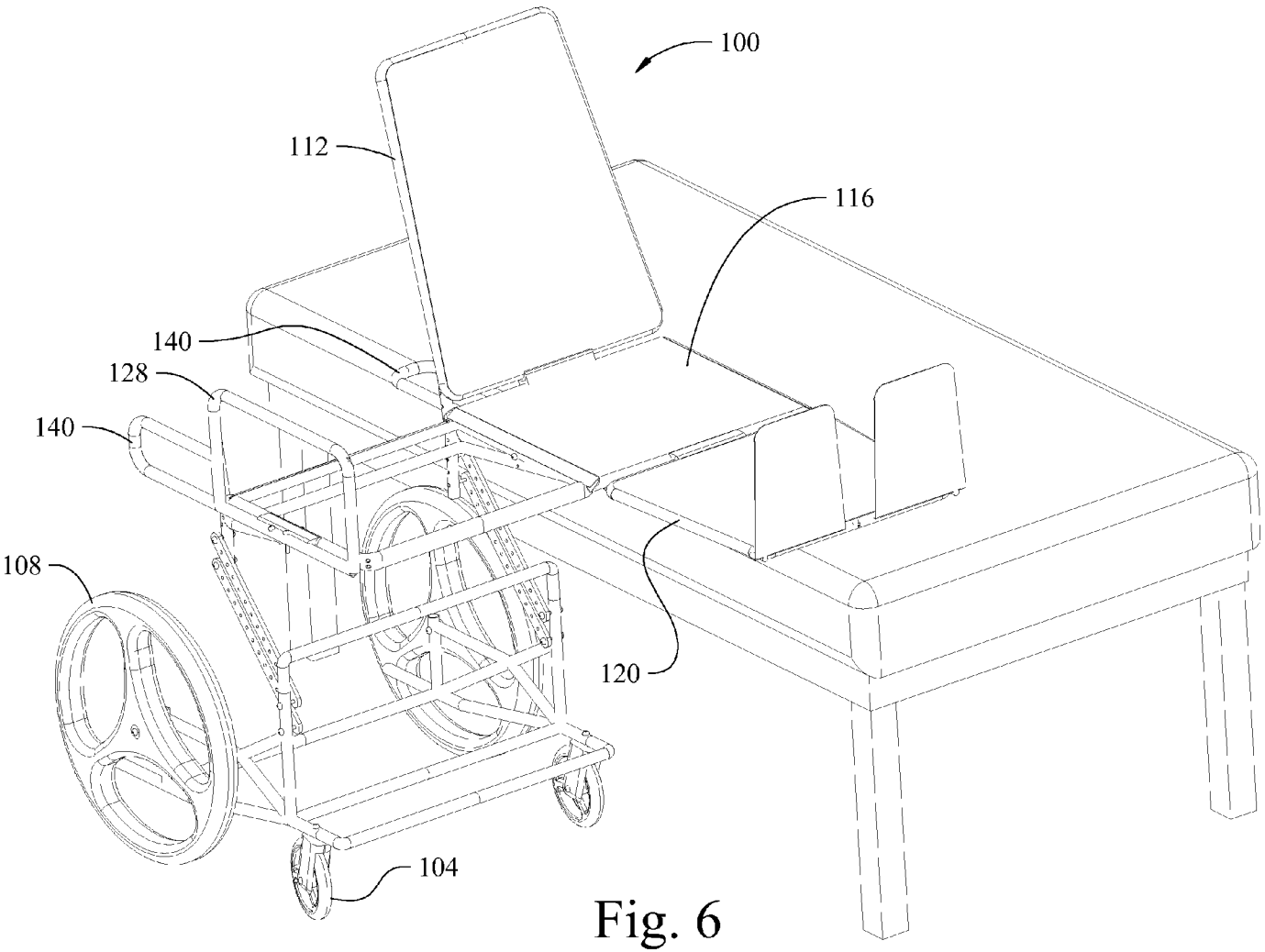
FIG. 6 is a perspective view of the wheelchair shown in FIG. 5, after the movable carriage (including the seat, backrest, and leg rest) has been moved along the folded down side rail or armrest, for patient transfer to/from the wheelchair in a seated position (e.g., ready for dismount from the seat to the bed, or vice versa).

Also in this illustrated embodiment, the armrests 128 also include extensions 140 that extend rearwardly relative to the tracks 134. When the armrest 128 is folded down, the extension 140 extending rearwardly therefrom is able to provide greater support for stabilizing the wheelchair 100 when the extension 140 is resting or weighted on the bed, gurney, toilet, etc. as shown in FIG. 6. In this example, the extensions 140 are generally U-shaped, although other configurations may also be used in alternative embodiments.

The wheelchair 100 also includes a lifting mechanism or means 144 for lifting and lowering the upper portion of the wheelchair frame including the carriage 136, armrests 128, extensions 140, and seat assembly (backrest 112, seat 116, leg rest 120, and feet supports 124). For example, the lift mechanism 144 of the wheelchair 100 may be used for raising the carriage 136, armrests 128, extensions 140, etc. from the initial height shown in FIG. 7 to the height shown in FIG. 8. This lifting, lowering, and resulting change in height allows the wheelchair 100 to accommodate different or varying heights of beds, gurneys, etc. For example, the armrests 128 and extensions 140 may be raised to a height that is sufficiently high enough above a support surface (e.g., bed, table, gurney, toilet, etc.) to allow the armrest 128 and extension 140 to be folded down so that they extension 140 and armrest 128 rest on top of the support surface as shown in FIG. 6. In some embodiments, the armrest 128 and extension 140 may be lowered after being folded so that the armrest 128 and extension 140 makes good contact with and abuts or presses against the bed.

FIG. 2 shows the armrest 128 folded down without first having being raised by the lifting mechanism 144. Depending on the relative height of the bed, toilet, etc. to the wheelchair armrest 128, the folding of the armrest 128 may typically occur after the armrest 128 has been raised upwardly to the bed height. As another example, FIG. 7 illustrates an alternate transfer position that may be used for a lower height bed. As shown in FIG. 7, the wheelchair 100 is not raised or lifted though the armrest 128 is folded down and carriage 136, backrest 112, seat 116, and leg rest 120 have been laterally moved along the tracks 134 defined by the armrest portion 132. By comparison, FIGS. 8 and 9 illustrates the wheelchair 100 again in the flattened, supine configuration but now after being raised or lifted, e.g., to match or correspond with the height of the bed or other surface onto which the patient is being transferred.

In this illustrated embodiment, the lifting mechanism 144 is shown as a pair of elongate links or members for purpose of illustration only and not for purpose of limitations. Alternative embodiments may include a differently configured lifting mechanism, such as the lifting mechanism 344 shown in FIGS. 13 through 16, a manual crank for manually lifting or lowering, and/or a lift mechanism that is electrically, pneumatically, etc. powered. For example, a wheelchair may include a lifting mechanism that includes hydraulic means, electric motor, gears, scissor lift, and/or electric pumps. Still further embodiments may not include any such lifting mechanism.

The wheelchair 100 is shown with a framework or frame assembly (e.g., armrests 128, sections 132, extensions 140, etc.) that are generally tubular with circular cross-sectional profiles. But this tubular frame assembly is illustrative only as other embodiments may include a differently configured frame assembly (e.g., non-tubular, non-circular, etc.). For example, another exemplary embodiment may include framework or frame assembly having solid, non-tubular portions for additional reinforcement, support and strength. Or, for example, the armrests may include solid planar surfaces as sidewalls instead of two downwardly extended tubular members.

When the armrest or side rail 128 is folded down to the horizontal position and locked in that position as shown in FIG. 6, the armrest 128 and extension 140 are operable similar to an outrigger to stabilize the wheelchair 100 by transferring some weight to the bed, toilet, etc. in this illustrated embodiment, the armrest 128 and extension thus serve as a stabilizer/outrigger both laterally and to prevent backwards tipping. In preparation for lateral patient transport. As the carriage 136 and seat 116 travel further over the now horizontal armrest/sides rails, additional weight is transferred to the bed, toilet, etc. In FIG. 6, the weight or load of the armrest 128, backrest 112, seat 116, leg rest 20 and patient sitting on seat 116 is shifted (or mostly shifted) to the bed. Thus, the folded armrest 128 serves as an extra support point in addition to the four wheels 104, 108. This additional support point allows the wheelchair 100 to have a narrower base (e.g., width similar to a conventional, standard wheelchair, etc.), as the extra support point provided by the armrest 128 and extension 140 allows for reductions in the overall width needed for safe patient transfers.

In addition, the armrest and rails may also be designed to permit the arm and tracks to rest on the bed (or other surface to/from which the patient is being transferred) at an angle other than perfectly horizontal. For example, in an exemplary embodiment, the armrest may fold down and incorporate a range of angles at which it could lock down relative to the seat platform and the portion of the rails between the two armrests. Alternatively, in another exemplary embodiment, the lifting mechanisms may be employed to create a track angle other than horizontal. In such an embodiment, for example, the side of the lifting mechanism farthest from the transfer side lifts slightly more than the near side, thus creating a downward angle in the tracks, for example to accommodate a bed, for example, that is not perfectly horizontal or sags in the center, etc.

Figure 4:
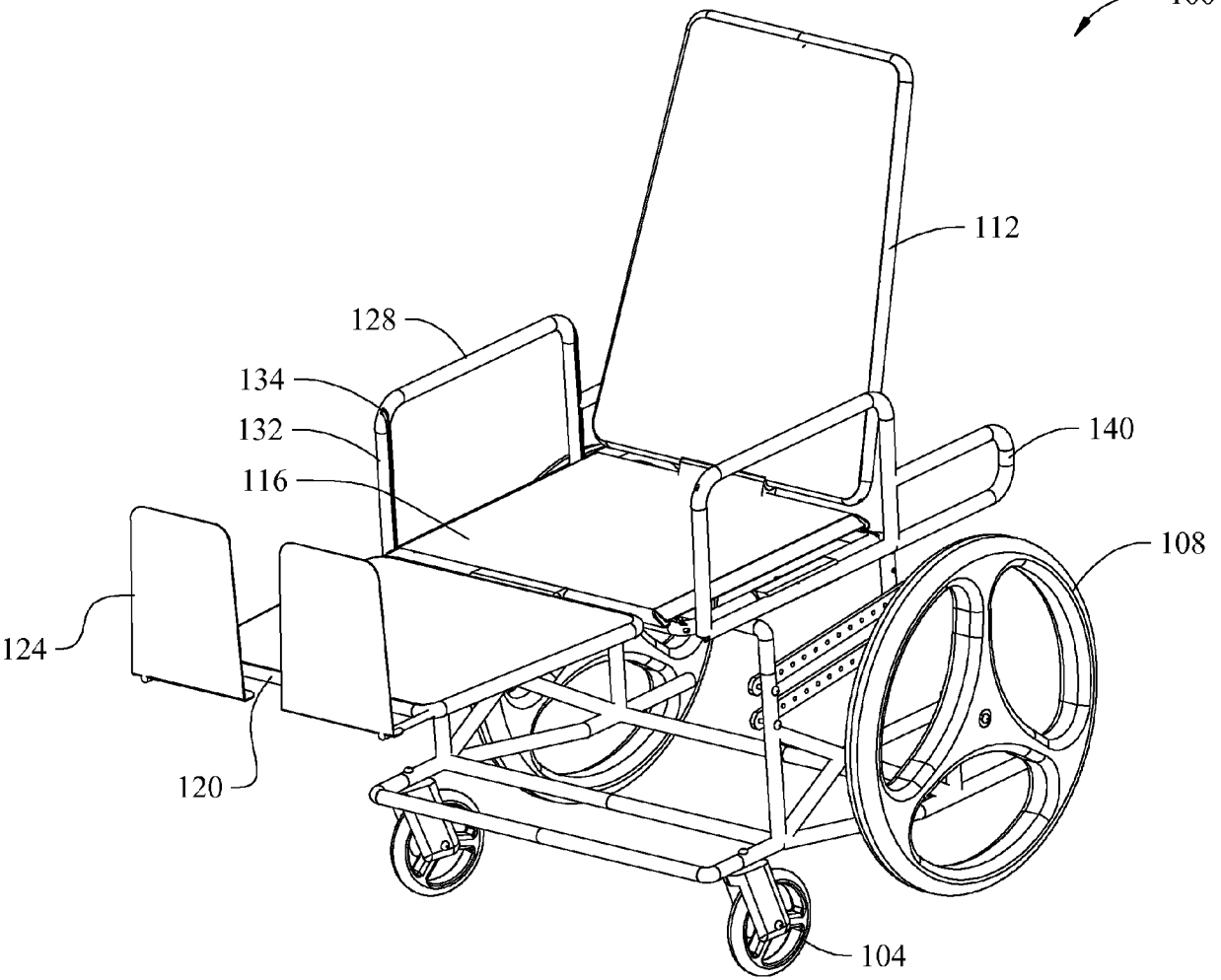
FIG. 4 is a perspective view of the wheelchair shown in FIG. 1, after the wheelchair's leg rest (with the feet supports attached thereto) has been lifted upward into a generally horizontal configuration.
Figure 5:
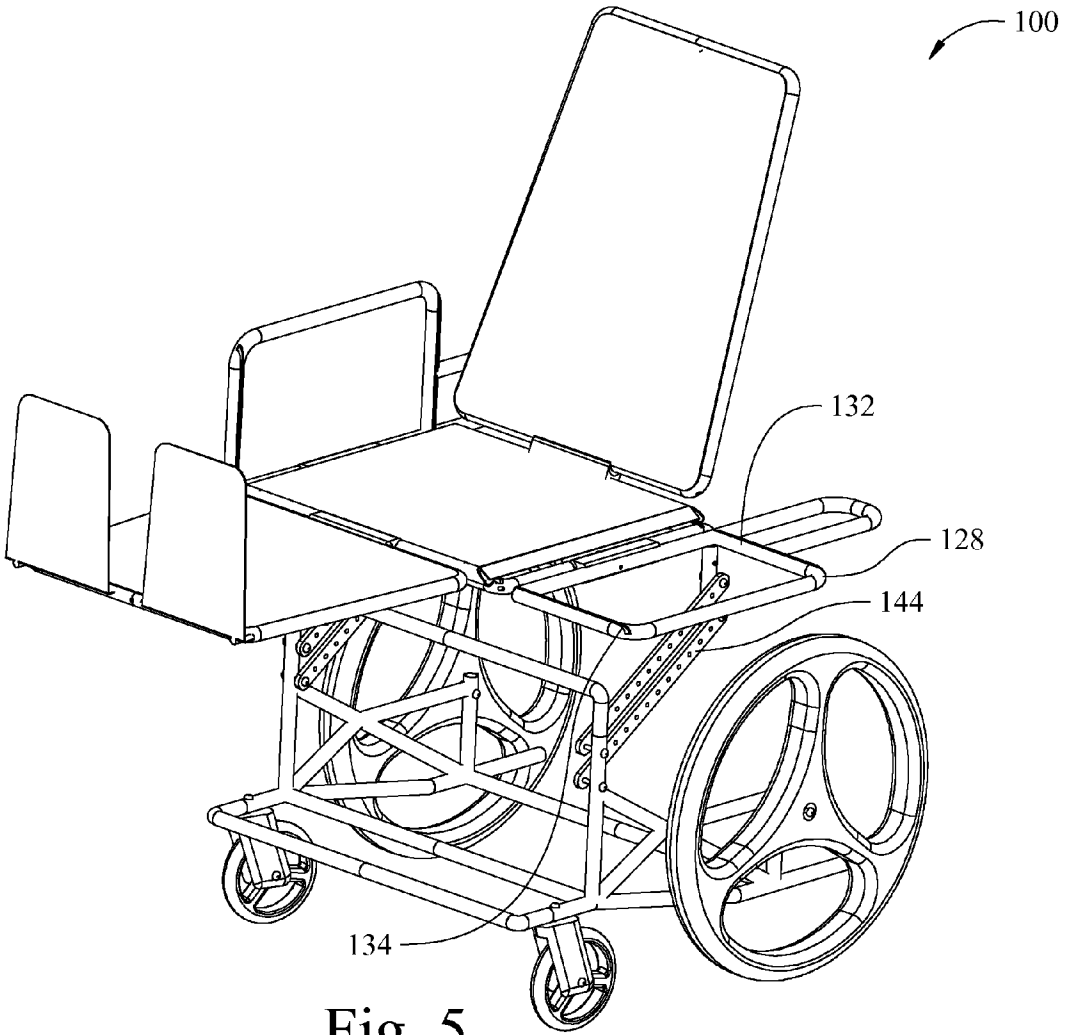
FIG. 5 is a perspective view of the wheelchair shown in FIG. 3, and illustrating the seat assembly (seat, backrest, leg rest, side rails or armrests, frame portions) lifted or raised upward and the side rail or armrest of the wheelchair in a generally horizontal configuration (ready for a seated-position patient transfer)

FIG. 4 illustrates the wheelchair 100 after the wheelchair's leg rest 120 (with the feet supports 124 attached thereto) has been lifted upward into a generally horizontal configuration and the backrest 112 slightly reclined in preparation for patient transfer. The feet supports 124 may also be folded relatively flat so as to be generally planar or parallel with the leg rest 120 in some embodiments.

In some exemplary embodiments, wheels, rollers, etc. may be disposed under the backrest 112, seat 116, and/or leg rest 120 to reduce friction or drag as the carriage 136, backrest 112, seat 116, and leg rest 120 are being moved across or over the bed. Such friction reducing mechanisms or devices facilitate an easier and less strenuous transfer of the supine or seated patient.

FIGS. 11 and 12 illustrate another exemplary embodiment of a wheelchair 200 embodying one or more aspects of the present disclosure. In this illustrated embodiment, various components of the wheelchair 200 may be similar to or identical in structure and/or function as the corresponding components of the wheelchair 100, such as the wheels 204, 208, back rest 212, leg rest 220, feet supports 224, armrests 228, frame sections 232, tracks 234, extensions 240, and lifting mechanism 244. In alternative embodiments, the wheelchair 200 may include components that are dissimilar or non-identical than the corresponding components of the wheelchair 100.

Additionally, this illustrated embodiment of the wheelchair 200 includes a removable seat section 250 (FIG. 12) that may be removed from the seat 216, for example, to provide toilet access while the patient remains sitting on the seat 216 of the wheelchair 200. In this example, the removable seat section 250 is removably coupled to the seat 216, such that removal of the seat section 250 exposes an opening 254 (FIG. 12) through the seat 216 and such that when coupled back to the seat 216, the removable section 250 covers the opening (FIG. 11).

The seat section 250 may be manually removable in some embodiments. Or, for example, the seat section 250 may be a section of the seat 216 that disengages (e.g., slides, etc.) and creates the toilet opening through the seat 216, for example, during the transport sequence such as when the seat 216 is moving along or across the folded down armrest 228.

In this example, the wheelchair seat 216 may be moved along the folded down armrest 228 so as to align the opening 254 in the seat 216 created by removal of section 250 with the toilet. In some embodiments, an insert may be added to the toilet seat in order to bring the toilet seat height to the same height or at least closer to the height of the bottom of the seat 250.

The wheelchair 200 may also be used for transferring the patient to a toilet, bed, gurney, table, etc. in a manner similar to that described above for wheelchair 100. In some embodiments, the wheelchair 200 may be configured so that the armrests or side rails 228 may be extended (e.g., slid, etc.) further outwardly beyond the wheels 208 in the corresponding left or right direction. This, in turn, may help enable the transfer of the patient between the wheelchair 200 to the toilet, etc. By way of example, the base of the seat 216 may be configured to slide or travel some amount left or right to enable further transport laterally for transferring, for example, to and from a toilet.

FIGS. 13 through 16 illustrate another exemplary embodiment of a wheelchair 300 embodying one or more aspects of the present disclosure. In this illustrated embodiment of FIG. 13, the seat cushion or padding has been removed so as to allow various components (e.g., framework or frame assembly, etc.) to be more clearly seen.

Also in this illustrated embodiment, various components of the wheelchair 300 may be similar to or identical in structure and/or function as the corresponding components of the wheelchair 100, such as the wheels 304, 308, back rest 312, leg rest 320, feet supports 324, armrests 328, extensions 340, frame sections 332, etc. In alternative embodiments, the wheelchair 300 may include components that are dissimilar or non-identical than the corresponding components of the wheelchair 100. For example, the wheelchair 300 shown in FIGS. 13 through 16 includes a vertical lift mechanism for lifting or raising the backrest 312, seat 316, leg rest 320, etc. The vertical lift mechanism has a torsional part 344, which is configured to be relative strong for accommodating large loads.

With reference to FIGS. 14 and 16, the side rails or armrests 328 of the wheelchair 300 may be hinged or pivotably coupled to corresponding end portions 358 of the frame members 360 of the chair base that extends under and vertically support the seat 316. Similar to that disclosed for wheelchair 100, either or both side rails and armrests 328 of the wheelchair 300 may be converted (e.g., pivoted sideways, hingedly moved, folded down, etc.) from the upright position shown in FIGS. 13 and 15 to a generally horizontal configuration (see, for example, a comparison of FIGS. 1 and 3). When in the generally horizontal configuration, the folded down armrest or side rail 328 aligns with the frame members 360 (e.g., inner surfaces align, etc.), which thereby defines or provides a path (e.g., tracks, rails, etc.) along which the carriage 336 may be moved.

In some embodiments, the armrests or side rails may have some flex in them to accommodate for variations in compression of the bed, gurney, or other location to which the patient is being transferred and help in more perfectly aligning the folded down armrest with the frame members. Additionally, or alternatively, some exemplary embodiments may be configured such that the seat, carriage, and/or tracking assembly as a whole might adjust in relative position and angle from level (during normal lift and decent, and lateral transfer) to permit some degree of tipping to accommodate, for example, a bed that sags in the middle and help with more perfectly aligning the folded down armrest with the frame members. The carriage or transport assembly might create such an adjustment (from perfectly level or horizontal) by employing or varying the amount of lift delivered on the left side versus the right side of the wheelchair in an exemplary embodiment.

FIGS. 14 and 16 illustrate exemplary rollers 364 that may be used to allow the carriage 336 to more easily be moved (e.g., with less friction, etc.) along the path defined or provided by the folded down armrest or side rail 328. In this illustrated embodiment, the rollers 364 are coupled to members 368 of the seat's recline frame. The seat's recline frame includes the recline axis that allows the seat, backrest, and leg rests to be reclined or tilted backward. Also, this particular embodiment includes generally hour-glass shaped rollers, though other roller configurations are possible.

In operation, the side-engaging rollers 360 bear and transfer weight via axial loading to other portions (e.g., members 368, etc.) of the wheelchair 300. The rollers 364 roll along the frame members 360 of the chair base frame, thus enabling the carriage 336 to be moved (e.g., slid or rolled, etc.) along the frame members 360 onto and then along the aligned portions of the folded down armrest or side rail 328. The rollers 364 guide or control the carriage's 336 sliding or transverse motion, such that there is only one axis of motion allowed. This particular configuration of rollers 364 also may allow for their installation or use without necessarily requiring additional height to be added to the wheelchair 300.

The rollers 364 illustrated in FIGS. 14 and 16 are but one example of a way to enable the carriage 336 to be movable along the frame members 360 that are under the seat onto and then along the portions of the folded down armrest or side rail 328. Alternative embodiments may include differently configured rollers, wheels, bearings, slide channels, etc. In addition, additional components may be added in exemplary embodiments such as one or more locks, slides, hydraulic lines, actuating cylinders, wires, accumulators, sliding links, sheaves, clutches, and/or remote drives.

In FIGS. 14, 15, and 16, the tilt mechanism (e.g., linkage assembly, etc.) of the seat assembly is shown tilting the seat upwardly (in a direction into the page in FIGS. 14, 15, and 16). In use, the titling of the seat assembly may facilitate rolling a patient in a supine position while lying down onto/off a flattened deck of the wheelchair 300 defined by the backrest 312, seat 316, and leg rest 320 off/onto a bed, gurney, table, etc. (see, for example FIGS. 7A and 10A).

By way of example, an exemplary embodiment of a wheelchair disclosed herein (e.g., wheelchair 100, 200 and/or 300, etc.) may be configured with automatic chair height compensation implemented with one or more safety interlocks for assuring safe operation of the patient transfer mechanism. For example, one or more safety locks may be provided that are engaged so as to lock and prevent the movable carriage from being moved until it is determined that the support of the bed (or other location to which the patient is being transferred) will bear the load shifting over onto it, e.g., so as not transport the patient without the folded down armrest or side rail being on the bed, etc. The chair height mechanism may also require compensatory adjustment made during transfer back to the chair. The scope of such adjustments may, for example, be based upon the compressibility of the bed, gurney, couch, etc. In such example, the transfer slide action of the carriage may be (inter)locked thereby disallowing motion or movement of the carriage to take place unless or until the chair is brought up to the needed height.

Injuries, illness, infirmity, and old age, force many people to rely, permanently or for extended periods of times, on wheelchairs—a primary means of transportation for non-ambulatory to be able to get from place to place. But particularly in the group of the very aged and/or very weak, the task of moving from the seated position in a wheelchair to a bed, toilet, etc. (and vice versa) can be a very difficult task for the person confined to the wheelchair. Such transfers are also difficult and injury-prone for the assisting caregiver especially when the patient is heavier than can be safely lifted by the caregiver. For example, a non-ambulatory patient usually requires the assistance of one or more caregivers to be transferred from a conventional wheelchair to a bed. As recognized by the inventors hereof, the lifting and transferring of a patient is difficult, in part due to the cantilevered position of the conventional wheelchair during such patient transfer. This also adds to the difficulties and increases the risk of injuries for both the patients and caregivers, which risks are exacerbated when the patient being transferred weighs more than the assisting caregiver. For hospitals, extra caregivers and dedicated lifting (or transfer) equipment can help mitigate these risks, but not without the higher costs associated with that extra equipment and/or additional staff. These higher costs may be problematic, for example, for nursing homes and in-home care situations having limited financial resources that are insufficient to allow for the acquisition of such extra lifting equipment and employment of multiple caregivers. Accordingly, the inventors' hereof have recognized the need for single-caregiver transfer solutions or solutions to assist wheelchair bound individuals in moving from and returning to their wheelchair, without placing undue strain on the wheelchair bound individual, or on a third party providing assistance such as a nurse or caregiver, who assists the person in this task. After recognizing this need, the inventors' designed the exemplary embodiments of the wheelchairs disclosed herein which fulfill this need and may also provide various advantages, including those disclosed herein, etc.

In developing the exemplary embodiments of the wheelchairs disclosed herein, the inventors have also recognized the following drawbacks associated with conventional wheelchairs. For example, the center of gravity of a conventional wheelchair typically lies somewhere forward of an imaginary line extending between its larger back drive wheels. This positioning of the center of gravity makes the wheelchair extremely stable. But for a wheelchair having a reclining or tilting seat, the center of gravity of the wheelchair and its user may shift rearward as the seat is reclined or tilted. Similarly, in attempting to transfer patients from their wheelchairs onto beds (or vice versa), the center of gravity can be shifted, not only rearward, but also the center of gravity may shift from center to a potentially unstable point that is left or right of center (and even outside the base formed by the two main wheels). Consequently, there exists a danger that the wheelchair may tip over and possibly cause injuries due to alterations or transitions in wheelchair configuration. For these reasons, the inventors hereof believe it would be advantageous to provide a wheelchair having such abilities to reconfigure to be able to stabilize from tipping without special outrigger or other (complex or costly) adaptations.

It has heretofore been a problem to transfer an invalid or disabled patient from a bed to a wheelchair or from a wheelchair to a bed without substantial manual stress or strain on a disabled patient. In most instances, a disabled patient must be manually picked up and placed in a wheelchair in order to transfer him from a bed to another location. This is particularly true in convalescing patients who spend part of their time in a wheelchair and the remaining portion of their time in bed. Such patients being disabled to the extent that they are unable to handle themselves in the movements to and from a wheelchair. Also, a critical patient care burden is patient transfers from the wheelchair to toilet, which generally is accomplished by the patient lifting him or herself from the chair onto the toilet. This is typically accomplished with the use of fixed or movable support arms in and around the toilet (for patients with use and sufficient strength in their arms and upper body). For caregiver transfers, the challenge of tight spaces often makes lifting and transferring the patient between the wheelchair and toilet a very challenging task. Many wheelchair patients are too heavy for some attendants or nurses, who are not physically equipped manually to transfer such heavy patients to and from a wheelchair and especially when the patient is being moved into or out of a bed relative to the wheelchair.

Accordingly, the inventors hereof have developed the various exemplary embodiments disclosed herein that have features to facilitate the handling of patients by allowing a wheelchair patient to be readily transferred directly onto the upper surface of a bed, to a toilet, etc. without the hazard of dropping the patient on the floor or creating undue discomfort of the patient. Exemplary embodiments include a wheelchair construction facilitating convertibility of such a wheelchair in order to transfer the patient from the wheelchair to a bed and back again, with only the assistance of a single caregiver including a single caregiver with no particular strength to lift the patient, and that enables the caregiver to transfer patients significantly heavier than the caregiver. Hospital beds and the like intended for use of bed type patients are elevated to an approximate counter height to enable nurses, doctors, and persons attending the needs of such patients to more easily do so without bending over or squatting to move or manipulate the patient in such bed. Conventional wheelchairs, on the other hand, have their seats more nearly disposed at a typical height of a chair such that the legs of the user/patient legs are so disposed with their feet but a short distance from the floor. The inventors' wheelchairs may be configured to support a patient at a substantial bed level when converted which height is considerably higher elevation than that of the seat of the wheelchair when in the normal configuration. In addition, the inventors' wheelchairs may also be able to accommodate a wide variety of bed heights for in-home and nursing home transfers, where bed heights may vary significantly. In such embodiments, the conversion of the wheelchair transfer device, and vice versa, may thus include an elevator or lift mechanism operatively associated with the seat and bed for changing the elevation, thereof, in the course of convertibility. Accordingly, in these exemplary embodiments, the wheelchair may thus be configured to assist in lifting a patient from the wheelchair and transporting onto a bed, and then returning the patient to the wheelchair with the assistance of only a single caregiver, such as a nurse, healthcare worker, or family member, etc.

In use, embodiments of the inventors' wheelchairs permit a patient to be transferred more efficiently from a wheelchair to a bed, etc. (and back) with the help of only a single caregiver without requiring significant physical exertion or skill from the caregiver. For those more able bodied patients, these transfers to/from the wheelchair may be made independently or solely by the patient without requiring any assistance from a caregiver. In such cases, the patient may be able configure the wheelchair for transfer mode, e.g., by folding down a side rail or armrest and/or by operating the controls. As disclosed herein, some embodiments include a lifting mechanism and/or powered slide mechanism. In such embodiments, the controls may be positioned to be accessible by the wheelchair user so that the user can access the controls to activate the lifting mechanism to raise and lower the wheelchair seat assembly and/or to active the powered slide mechanism to cause the carriage to slid outwardly or inwardly.

In exemplary embodiments, the wheelchair is configured so that is able to adapt (by raising and lowering) to varying bed heights, then to also convert from sitting to supine, flat and inclined positions to prepare for loading and unloading (with possible interim step or steps, including in a slightly reclined-legs-flat position, before fully reclining). In use, the wheelchair may be positioned or "parked" next to a bed, gurney, table, etc., and then be used to transport the patient sideways (perpendicular to forward or rearward travel direction of the chair). In some embodiments, both armrests or side rails may be convertible such that the unloading and loading of the wheelchair may occur on either side. The unloading, for example, may occur by moving the patient fully over and onto the bed before depositing them onto the bed (e.g., middle of the bed, etc.) a distance away from the edge of the bed. During the transport mode, the patient's center of gravity may be raised relative to the bed and shift rearward as the seat back/backrest reclines into the supine position. Here, the armrest serves as a stabilizer/outrigger both laterally and to prevent backwards tipping. The armrest design is specifically adapted to extend further rearward than needed for its function as an armrest in these embodiments. The added extension (if used) engages the bed or surface to provide further stability, in particular for the supine transfer when the center of gravity shifts rearward. Also, the transport carriage is adjustable to uneven heights and varying degrees of support on the bed such that the patient is still supported evenly across the bed or mattress surface despite, for example, the bed having varying degrees of compression due to variations in bed spring strength and compression such as at the bed's center where the springs are typically weakened due to repeated use.

By way of example, some embodiments may include armrests or side rails that have some flex in them to accommodate for variations in compression of the bed, gurney, or other location to which the patient is being transferred. Additionally, or alternatively, some exemplary embodiments may be configured such that the seat, carriage, and/or tracking assembly as a whole might adjust in relative position and angle from level (during normal lift and decent, and lateral transfer) to permit some degree of tipping to accommodate, for example, a bed that sags in the middle. The carriage or transport assembly might create such an adjustment (from perfectly level or horizontal) by employing or varying the amount of lift delivered on the left side versus the right side of the wheelchair in an exemplary embodiment.

As disclosed herein, the inventors wheelchairs include chair arms, armrest, and seat side panels that are used as part of the transport mechanism, thus avoiding the need to move such features out of the way during the patient transfer operation. Further, this is accomplished while using large back wheels that may be similarly sized to the back wheels of a conventional wheelchair, thus allowing the inventors' wheelchairs to be self-propelled or powered by the patient/user in the traditional method of using one's hands to propel the wheels to move and steer the wheelchair. In turn, the use of large back wheels thus eliminates the requirement that the wheelchair be electrically powered or only movable with caregiver assistance. Despite this, some exemplary embodiments may still include an electrically powered wheelchair and/or wheelchair with relatively small wheels, as such should not be considered as being outside the scope of the present disclosure.

In at least some embodiments, the inventors' wheelchair does not require outriggers or leg supports that are configured to stabilize the wheelchair while the patient is being loaded and unloaded. As disclosed herein, the folded down or converted armrest or side rail may be used to transfer weight to the bed mattress and reduce the structural as well as base support typically required for preventing chair and patient instability. The inventors' unique design facilitates wheelchair patient transfer without requiring extra means to tether or anchor the wheelchair to the bed during the transport mode, as exemplary embodiments of the inventors' wheelchair may instead rely on friction, compression, and chair/patient weight to both maintain balance and effectively secure the wheelchair to the bed.

For lateral transport of the patient from centered over the chair to over the bed, the wheelchair may allow for the transport of the patient in a reclined but still sitting position, and also to transport via wheels, tracks, bearings, etc. that enable smoothly transporting the patient and seat out over the bed and back when re-loading. As disclosed herein, the base or tracks for such transport may occur by folding down one of the armrests (the one on the side to unload/load the patient) over and onto the bed surface, where the inner surface of the wheelchair armrest becomes the base or tracks over which the wheels, bearings, etc. roll or transport (creating a solid surface or track to facilitate such horizontal, lateral, or perpendicular transport of the carriage, seat, and patient). Accordingly, a patient may thus be transported laterally/horizontally on either side of the wheelchair over the wheels depending on which left or right side of the wheelchair is positioned next to the bed. In such embodiments, the wheel diameter may thus be sized so that the height of the wheels (including necessary clearance etc., but generally where the wheel height is lower than the basic or most bed heights) is low enough to permit the armrest to fold down over the bed and to permit the carriage to be transported over and on the folded armrest. The wheels may also be sized with sufficiently large diameters such that an able patient could manually drive the wheels to transport, steer, and control the wheelchair by his or herself using standard methods to propel, brake, and steer with his or her hands on each of the two large weight-bearing, main wheels.

Some embodiments may also be configured to accommodate transport of the patient laterally from the chair onto a toilet (with the toilet set at an height appropriate for the wheelchair transport or possibly in conjunction with toilet seat height adapter to adjust the height to provide such functionality consistently). For such transfers to and from the toilet, the inventors' wheelchair design may allow for patient transfer without caregiver assistance for those patients that are more physically able such as patients that are able to transfer themselves with conventional wheelchairs with the use of conventional support rails.

In an exemplary embodiment, the inventors' wheelchair may have large enough main, weight-bearing wheels to efficiently move over rough terrain or even steps, for example, roughly having an outside diameter within a range from about 20 inches to about 24 inches, though differently sized wheels may be used in other embodiments. The large wheels permit direct patient powering, moving and steering the wheelchair as desired and able, much like for a standard conventional wheelchair. This exemplary embodiment also includes a mechanism or module where the seat is incorporated into a carriage that is designed to travel laterally to transport the patient.

Also in this example, the seat/carriage is incorporated into a frame that is lifted in the first step of operation to lift the carriage or seat of the wheelchair to near or at the height of the bed, or other surface onto which the patient is intended to be transferred. The wheelchair's back, leg, and seat support sections may also be reconfigurable, such that the backrest may be reclined further and the leg supports may be swung fully up to be horizontal with the seat section. The seat section may be tipped backwards separately from the leg and back support sections in this embodiment, if desired for patient transport. The reconfiguration of the chair and patient into a reclined, legs-straight, seated position (as if one were in a lounge chair) is in preparation for lateral transport of the patient onto a bed or similar surface. It is also possible to laterally transport the patient in fully supine position with this embodiment.

Continuing with a description of this exemplary embodiment, the armrests and sides of the wheelchair (the sides being the section or elements below the armrests that support the armrests) are configured to fold down from their standing upright or vertical orientation to fold generally flat or horizontal on the bed, toilet, or other surface onto which the patient would be transported. When folded down, these side sections define tracks or other path along or over which the seat/carriage may laterally traverse or travel sideways from an initial position between the wheels to a transfer position over one wheel. In some exemplary uses of the wheelchair, the carriage, supporting back rest, and seat may be configured into fully supine position and the bed itself may also tip or angle to more easily roll patients off or back onto the device for unloading or loading. In some embodiments, the above mentioned tipping mechanism of the seat assembly may provide this assistance. The patient may also be rolled onto his or her side on one shoulder during the transfer process.

Numerical dimensions and values are provided herein for illustrative purposes only. The particular dimensions and values provided are not intended to limit the scope of the present disclosure.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter. The disclosure of a first value and a second value for a given parameter can be interpreted as disclosing that any value between the first and second values could also be employed for the given parameter. Similarly, it is envisioned that disclosure of two or more ranges of values for a parameter (whether such ranges are nested, overlapping or distinct) subsume all possible combination of ranges for the value that might be claimed using endpoints of the disclosed ranges.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A wheelchair convertible for laterally transferring a patient to and/or from the wheelchair, the wheelchair comprising:

a base with two main full-sized wheelchair wheels;

a complete connected upper wheelchair seat assembly including a leg support, a seat, and a backrest which are configurable in various seating positions and a fully flat position;

at least one armrest alongside the seat and configurable between at least:

a first configuration in which the armrest is generally upright and vertical relative to the seat; and a second configuration in which the armrest is non-vertical and extends laterally outward relative to the seat;

a carriage coupled to the seat and movable along at least a portion of the armrest when the armrest is in the second configuration, such that the carriage and seat are laterally moveable together in a transverse direction relative to a forward direction of the wheelchair;

a lifting mechanism that can raise the carriage;

wherein the armrest is attached directly to the lifting mechanism or a frame, but the armrest is not directly connected to the backrest, the seat, or leg support;

wherein the armrest can rotate or fold down and lock into position to form or extend tracks;

wherein the tracks and an underside of the seat and carriage securely attach to one another while allowing lateral fully controlled transverse movement by the carriage without tipping or rocking;

whereby the lifting mechanism is operable for lifting the carriage, which can then permit lateral movement of the carriage and seat assembly along the tracks and enable transfer from the seat assembly of a patient in a seated or a supine position laterally without engaging the full-sized wheelchair wheel.

2. The wheelchair of claim 1, wherein the at least a portion of the armrest when in the second configuration integrally defines a path along which the carriage is slidable.

3. The wheelchair of claim 2, wherein the armrest includes:

an upper portion against which a patient's arm may rest during use of the wheelchair; and frame portions depending from the upper portion, the frame portions include tracks defining the path along which the carriage is slidable.

4. The wheelchair of claim 1, wherein the armrest includes an extension configured to contact a surface to/from which a patient is being transferred, whereby the armrest and extension are operable as a stabilizer/outrigger such that contact of the armrest and extension with the surface allows weight to be transferred to the surface via the armrest, provides additional stability and support for the wheelchair during patient transfer, and helps prevent backwards tipping.

5. The wheelchair of claim 1, wherein:

the wheelchair includes front and back pairs of wheels rotatable about a rotational axis for moving the wheelchair in a forward or rearward direction the carriage and seat are laterally moveable together in a transverse direction relative to the forward direction of the wheelchair between at least:

a first position in which the carriage and seat are laterally disposed between the front pair of wheels and the back pair of wheels; and a second position in which the carriage and seat are laterally disposed outside of the wheels on a left or right side of the wheelchair after being moved along the at least a portion of the armrest in the second configuration that extends laterally outward on the same left or right side of the wheelchair, thereby allowing lateral transfer of a patient to and/or from the wheelchair along the same left or right side thereof.

6. The wheelchair of claim 5, wherein:

the armrest is configured such that the armrest is pivotably movable or foldable downwardly from the first configuration to the second configuration;

the armrest is generally perpendicular to a rotational axis of the front and back pair of wheels when the armrest is in the first configuration; and the armrest is generally horizontal and parallel with the seat when the armrest is in the second configuration.

7. The wheelchair of claim 1, wherein the seat, backrest, and leg rest of the seat assembly are configurable into a plurality of configurations including one or more of:

a first seated upright configuration in which a patient may be laterally transferred from the seat assembly of the wheelchair while sitting; and/or a second, feet-up configuration in which a patient may be laterally transferred from the seat assembly of the wheelchair while sitting with his or her feet up; and/or a third flattened configuration in which a patient may be laterally transferred from the seat assembly of the wheelchair while lying down in a supine position.

8. The wheelchair of claim 1, wherein:

the seat includes a removable section removably coupled to the seat, the removable section configured such that its removal exposes an opening through the seat and such that when coupled back to the seat, the removable section covers the opening; and/or the at least one armrest comprises a pair of armrests along opposite sides of the seat, each said armrest being configurable between the first and second configurations, thereby allowing lateral patient transfers along either side of the wheelchair.

9. The wheelchair of claim 1, further comprising one or more rollers, wheels, and/or bearings coupled to the carriage such that the carriage and seat are laterally moveable together in a transverse direction relative to a forward direction of the wheelchair via said one or more rollers, wheels, or bearings traveling along the at least a portion of the armrest in the second configuration.

10. The wheelchair of claim 1, further comprising:

rollers coupled to the carriage such that the carriage and seat are laterally moveable together in a transverse direction relative to a forward direction of the wheelchair via the rollers rolling along the at least a portion of the armrest in the second configuration;

front and back pairs of wheels for moving the wheelchair in a forward or rearward direction; and a chair base configured to support the carriage and chair when the carriage and chair are laterally disposed between the front pair of wheels and back pair of wheels, the chair base includes surfaces that align with surfaces of the at least a portion of the armrest when the armrest is configured into the second configuration, thereby allowing the rollers to roll along and transition between the aligned surfaces of the chair base and the armrest.

11. The wheelchair of claim 10, wherein the rollers are configured to bear and transfer weight via axial loading to the corresponding chair base and/or armrest along with the rollers are rolling.

12. The wheelchair of claim 1, wherein:

the seat, backrest, and leg rest of the seat assembly is configurable into at least a flattened configuration in which the seat, backrest, and leg rest are aligned and generally planar with each other so as to collectively define a support surface to/from which a patient may be transferred while lying down in a supine position; and the support surface defined by the seat, backrest, and leg rest when in the flattened configuration is adjustable between at least a first, horizontal orientation in which the support surface is horizontal and a second, tipped orientation in the support surface is slanted upwardly or downwardly at an angle relative to horizontal.

13. The wheelchair of claim 1, wherein:

the wheelchair is configured to enable lateral transfer of a patient to/from the wheelchair regardless of whether the patient is seated upright on the seat or the patient is supine and lying down; and/or the seat assembly includes an outer portion that is rotatable for assisting in conveying a patient on/off the outer portion during patient transfer.

14. A wheelchair comprising:

a base with two main full-sized wheelchair wheels;

a complete connected upper wheelchair seat assembly including a leg support, a seat, and a backrest which are configurable in various seating positions and a fully flat position;

a carriage coupled to the seat such that the carriage and seat are laterally moveable together in a transverse direction relative to a forward direction of the wheelchair; and at least one armrest alongside the seat and configured to be folded or pivotably moved outward to integrally define a path along which the carriage is slidable;

a lifting mechanism that can raise the carriage;

wherein the armrest attached directly to the lifting mechanism or a frame, but the armrest is not directly connected to the backrest, the seat, or leg support;

wherein the armrest can rotate or fold down and lock into position to form or extend tracks;

wherein the tracks and an underside of the seat and carriage securely attach to one another while allowing lateral fully controlled transverse movement by the carriage without tipping or rocking; and whereby the lifting mechanism is operable for lifting the carriage, which can then permit lateral movement of the carriage and seat assembly along the tracks and enable transfer from the seat assembly of a patient in a seated or a supine position laterally without engaging the full-sized wheelchair wheel.

15. The wheelchair of claim 14, further comprising:

the lifting mechanism configured for raising or lowering the armrest, carriage, and seat to adjust the height thereof to correspond with a height of a surface to/from which a patient is being laterally transferred; and/or rollers coupled to the carriage such that the carriage and seat are laterally moveable together in a transverse direction relative to a forward direction of the wheelchair via the rollers rolling along the at least a portion of the armrest in the second configuration.

* * * * *